US008023659B2

(12) United States Patent
Hamanaka et al.

(10) Patent No.: US 8,023,659 B2
(45) Date of Patent: Sep. 20, 2011

(54) MIXING SYSTEM, METHOD AND PROGRAM

(75) Inventors: Masatoshi Hamanaka, Tsukuba (JP); Yuuya Iketuki, Musashino (JP)

(73) Assignee: Japan Science and Technology Agency, Kawaguchi-shi (JP)

( * ) Notice: Subject to any disclaimer, the term of this patent is extended or adjusted under 35 U.S.C. 154(b) by 839 days.

(21) Appl. No.: 11/993,153

(22) PCT Filed: Jun. 20, 2006

(86) PCT No.: PCT/JP2006/312332

§ 371 (c)(1), (2), (4) Date: Apr. 3, 2008

(87) PCT Pub. No.: WO2006/137400

PCT Pub. Date: Dec. 28, 2006

(65) Prior Publication Data

US 2009/0034766 A1 Feb. 5, 2009

(30) Foreign Application Priority Data

Jun. 21, 2005 (JP) ..... 2005-180772

(51) Int. Cl.
*H04R 5/02* (2006.01)

(52) U.S. Cl. ..... 381/10; 381/1

(58) Field of Classification Search ..... 381/1, 61, 381/56, 300, 308–310

See application file for complete search history.

(56) References Cited

U.S. PATENT DOCUMENTS

| | | | | |
|---|---|---|---|---|
| 3,962,543 | A | 6/1976 | Blauert et al. | |
| 5,696,831 | A | 12/1997 | Inanaga et al. | |
| 6,826,282 | B1 | 11/2004 | Pachet et al. | |
| 2002/0015504 | A1 | 2/2002 | Kohno et al. | |
| 2009/0214058 | A1 * | 8/2009 | Christoph et al. | 381/119 |

FOREIGN PATENT DOCUMENTS

| | | |
|---|---|---|
| EP | 0 744 881 | 7/2004 |
| JP | 02-025900 | 1/1990 |
| JP | 07-336793 | 12/1995 |
| JP | 09-090963 | 4/1997 |
| JP | 09-205700 | 8/1997 |
| JP | 10-172390 | 6/1998 |
| JP | 2001-275197 | 10/2001 |
| JP | 2003-143683 | 5/2003 |

* cited by examiner

*Primary Examiner* — Kimberly Lockett
(74) *Attorney, Agent, or Firm* — Rankin, Hill & Clark LLP

(57) ABSTRACT

In a situation where a plurality of virtual sound sources are fixedly located, a mixing system allows a listener to increase or decrease the sound volumes of the virtual sound sources with a simple operation. Directional angle difference detection means 24 detects a directional angle difference between a predetermined reference directional angle and an indicated directional angle which is determined by the listener by pointing with an operation unit 7 a certain direction in a virtual space where the virtual sound sources exist. Mixing means 5 mixes a plurality of audio signals supplied from a plurality of audio channels and outputs a mixed audio signal without adjustment, when the directional angle difference is zero degrees. When the directional angle difference is other than zero degrees, the mixing means 5 creates a situation where the plurality of virtual sound sources are fixedly located with respect to the reference directional angle, and mixed the plurality of audio signals so that the sound volumes of one or more sound sources arranged in a direction of the indicated directional angle may be larger than those of the one or more sound sources at the time that the directional angle difference is zero degrees.

13 Claims, 15 Drawing Sheets

$\delta = 0$ $\delta = 0.6$ $\delta = 0.8$

MIXING SYSTEM, METHOD AND PROGRAM

TECHNICAL FIELD

The present invention relates to sound mixing technology, and particularly relates to a mixing system, mixing method and mixing program which allow listeners to control the mixing.

BACKGROUND ART

A human being has the ability to know the location of a sound source based on a plurality of factors such as interaural intensity difference (IID), interaural time difference (ITD), and changes in frequency characteristics by using two ears. Generally, music recorded on a compact disc and so on has been mixed down using a music mixing system by adjusting the sound volumes and localization or panpots of a plurality of sound sources (musical instruments etc.) so that the respective sound sources are well separated for ready listening. Accordingly, when the mixed-down music is reproduced, the sound volumes and localization of the plurality of sound sources have already been fixed. It is impossible for users to adjust them even when they want to increase the sound volume of a specific sound source, for example, when users want to increase the sound volume of the first violin in a piece of classical music without changing the sound volume of the music piece itself.

If users could manipulate the music mixing system by hand while listening to the music, it would be possible to change the sound volume and localization or panpot of the specific sound source. Actually, however, manipulation of the music mixing system is too complicated for amateur users to operate intuitively. Incidentally, a mixing apparatus with a recording/reproducing function disclosed in Japanese Patent No. 3633459 (refer to Patent Reference 1) is complicated in operation, and it is not easy for ordinary users (listeners) to increase the sound volume of a particular part they want to hear, or decrease the sound volume of a particular part they do not want to hear when listening to the music.

For example, it is difficult to quickly perform a series of adjusting operations to increase the sound volume of a violin, to set the panpot at the center of two speakers (setting the sound volume ratio of the violin output from the left/right speakers to 1/1), and adjusting the localization or panpots of the other musical instruments by slightly decreasing the sound volumes thereof when the violin solo part has started.

By a method of controlling a system for producing a realistic musical sensation disclosed in Japanese Patent Application Publication No. 2000-69600 (Patent Reference 2), it may be possible to arrange sound sources in a three-dimensional space and to change the locations of the sound sources and listeners. However, by this method, it is difficult to for a listener to arrange near the listener the a particular part of the music that the listener wants to hear and to increase the sound volume of that part, or to arrange apart from the listener a particular part that the listener does not want to hear and to decrease the sound volume of that part while the listener is listening to the music.

A conventional product equipped with a gyro-sensor (acceleration sensor) on the headphone is substantially different from the present invention in which mixing is performed by changing the sound volume and localization or panpot of each sound source using information acquired from sensors. This conventional product is intended to prevent a disorder of the sound field due to the listener's head movement (that is, when the listener moved his/her head in a certain direction, he/she feels like the sound source accordingly moving in the same direction) by finely adjusting the sound direction in accordance with the inclination of the listener's head. Japanese Patent Application Publication No. 02-25900 (Patent Reference 3) discloses a technique to enhance a realistic musical sensation by mounting a vibration gyroscope onto a headphone a listener wears on the head so as to detect movements of the listener's head and to adjust the sound volume on either side of the headphone in accordance with the detected movements of the listener's head. In this manner, sound sources may be fixedly located within a space even when the listener's head moves, thus enhancing the realistic musical sensation. Japanese Patent Application Publication No. 08-9490 (Patent Reference 4) discloses a technique to detect a turning angle of the listener's head by using a microphone mounted onto the headphone. Further, Japanese Patent Application Publication No. 09-205700 (Patent Reference 5) discloses a technique to detect in which direction the listener's head equipped with the headphone is facing. Furthermore, Japanese Patent Application Publication No. 08-237790 (Patent Reference 6) discloses a technique to detect information on not only a turn of a listener's head but also the facing direction and location of the listener.

With existing amplifiers which are capable of separately adjusting an amplification factor for either side speaker, and existing vocal canceling machines, namely, equipment capable of removing a sound localized at the center, it may be possible to partially change the sound volumes and panpots of respective parts of the mixed-down music, but such apparatuses are not practically usable in adjusting the sound volume or localization of a specific sound source.

Patent Reference 1: Japanese Patent No. 3633459.

Patent Reference 2: Japanese Patent Application Publication No. 2000-69600

Patent Reference 3: Japanese Patent Application Publication No. 02-25900

Patent Reference 4: Japanese Patent Application Publication No. 08-9490

Patent Reference 5: Japanese Patent Application Publication No. 09-205700

Patent Reference 6: Japanese Patent Application Publication No. 08-237790

DISCLOSURE OF THE INVENTION

Problems to be Solved by the Invention

Conventionally, it has been difficult for listeners to increase the sound volume of a desired sound source or reduce the sound volume of an unnecessary sound source on a real-time basis, or continuously change the sound volumes and localization or panpots of the sound sources. In other words, it has conventionally been difficult to do such mixing as increasing or decreasing with a simple operation the sound volume of a particular part (sound source) that the listener specifies in a condition where a plurality of virtual sound sources are fixedly located.

A specific object of the present invention is therefore to provide a mixing system in which a listener can readily increase or decrease the sound volume of a desired sound source specified by the listener in a condition where a plurality of virtual sound sources are fixedly located, a method therefor, and a computer program therefor.

Means of Solving the Problem

A mixing system according to the present invention comprises mixing means for mixing a plurality of audio signals and outputting a mixed audio signal to a sound reproducing apparatus which produces a plurality of virtual sound sources around a listener, and the plurality of audio signals are supplied from a plurality of audio signal channels respectively associated with the plurality of virtual sound sources. The mixing system according to the present invention also comprises an operation unit to be operated by the listener and directional angle difference detection means provided in the operation unit. The directional angle difference detection means detects a directional angle difference (or aziumuth angle difference) between a predetermined reference directional angle (or reference azimuth angle) and an indicated directional angle which the listener determines by indicating with the operation unit a certain direction within a virtual sound source space where the plurality of virtual sound sources exist. As specifically described below, the mixing means mixes the plurality of audio signals supplied from the plurality of audio signal channels by performing sound volume adjustment and phase adjustment for the audio signals (in stereo audio equipment, for example, adjustment of the sound volume ratio for sounds outputted from left and right speakers), and outputs the mixed audio signal. First, the mixing means mixes the plurality of audio signals supplied from the plurality of audio signal channels without adjustment and outputs the mixed audio signal when the directional angle difference is zero degrees. When the directional angle difference is other than zero degrees, the mixing means creates a state where the plurality of virtual sound sources are fixedly located with respect to the reference directional angle so that the sound volumes of one or more of the virtual sound sources located in a direction determined by the indicated directional angle may be higher than that of the one or more virtual sound sources at the time that the directional angle difference is zero degrees.

According to the present invention, when the listener indicates with the operation unit a certain direction within the virtual sound source space where the plurality of virtual sound sources exist, the directional angle difference detection means detects a directional angle difference between the reference directional angle and the indicated directional angle. The mixing means then creates a state where the plurality of virtual sound sources are fixedly located with respect to the reference directional angle, and adjusts the sound volumes of the one or more of the virtual sound sources located in the indicated directional angle, which is determined by the listener using the operation unit, so that the sound volume thereof may be higher than that of the one or more virtual sound sources at the time that the directional angle difference is zero degrees. In this manner, the listener may easily increase the sound volume of any virtual sound source located in a direction the listener indicates, i.e., a particular musical instrument part that the listener wants to listen to, without moving the location of the plurality of virtual sound sources. Accordingly, listeners who are not familiar with complicated mixing technology, may freely control the sound volume of a particular part merely by pointing to an appropriate direction using the operation unit. To decrease the sound volume, what is necessary is just to change the indicated directional angle, which has been determined by the listener using the operation unit, to another direction (for example, to the direction of the reference directional angle).

Preferably, the mixing system may further comprise angle range setting means for setting a given directional angle range centering on the indicated directional angle. The mixing means is configured to perform, when the directional angle range is set, the sound volume adjustment for the plurality of audio signals supplied from the plurality of audio signal channels so that the sound volume of one or more of the virtual sound sources located within the directional angle range may be higher than that of the one or more of the virtual sound sources when the directional angle difference is zero degrees, and that the sound volume of other virtual sound sources located out of the directional angle range may be lower than that of the one or more of the virtual sound sources located within the directional angle range (or the sound volume may be reduced to zero). In this manner, it may be possible to increase the sound volume of only a specific virtual sound source located within a given directional angle range, compared with that of the other peripheral virtual sound sources. Accordingly, listeners can listen to the sound of any desired virtual sound source more clearly than others.

Preferably, the mixing means may comprise a channel selection section and a mixing section. Once the directional angle range has been set, the channel selection means calculates a directional angle difference between the indicated directional angle and each directional angle of the plurality of virtual sound sources, and selects one or more of the audio signal channels respectively associated with one or more of the virtual sound sources that are located within the directional angle range, based on the calculated directional angle difference. The mixing section performs the sound volume adjustment for the plurality of audio signals supplied from the plurality of audio signal channels so that the sound volume of one or more of the audio signals, which are supplied from one or more of the audio signal channels which have been selected by the channel selection section, may be higher than that of other audio signal channels which have not been selected. With this arrangement, it becomes simple to select one or more virtual sound sources located within the directional angle range on the basis of the indicated directional angle.

Preferably, the directional angle range setting means includes a range-control switch provided in the operation unit. it is preferred that the angle range setting means narrows the directional angle range when the range-control switch is operated in a closing direction, and expands the directional angle range when the range-control switch is operated in an opening direction. With such range-control switch, the directional angle range may be narrowed down only with the operation of the range-control switch so that the sound volume of a specific virtual sound source may be adjusted in a simple manner. Incidentally, the range-control switch may be configured to be automatically returned to the opening direction with a spring mechanism etc. With such spring mechanism, operation of the range-control switch becomes simple.

Preferably, the mixing system may further comprise elevation angle difference detection means for defining as a reference elevation angle an elevation angle of the operation unit when the reference directional angle is determined, and for detecting a difference between the reference elevation angle and an elevation angle of the operation unit as an elevation angle difference and for outputting the detected elevation angle difference. Here, the elevation angle difference detection means outputs the elevation angle as a positive angle when the operation unit is directed upward from a posture with which the reference directional angle has been determined, and outputs the elevation angle as a negative angle when the operation unit is directed downward from the posture. With such elevation angle difference detection means, as specifically described below, the mixing means is configured to perform the sound volume adjustment for a plurality of audio signals supplied from a plurality of audio signal channels respectively associated with a plurality of virtual sound sources located in a direction of the indicated directional angle. Namely, when the elevation angle difference detection means is outputting a positive elevation angle difference, the mixing means increases the sound volumes of the plurality of virtual sound sources located in the direction of the indicated directional angle in proportion to the elevation angle difference. Further, the sound volume (amplification factor) of the virtual sound source is increased in proportion to the distance between the operation unit and the virtual sound source. As well, when the elevation angle difference detection means is outputting a negative elevation angle difference, the mixing means decreases the sound volumes of the plurality of virtual sound sources located in the direction of the indicated directional angle in proportion to the negative elevation angle difference. Further, the sound volume (amplification factor) of the virtual sound source is decreased in proportion to the distance between the operation unit and the virtual sound source. In this manner, the sound volumes of the plurality of virtual sound sources located in the direction of the indicated directional angle may be selectively increased and decreased by changing the elevation angle of the operation unit. That makes it possible to intensively listen to the sound of a specific virtual sound source.

Preferably, the operation unit may be constituted from a headphone as a main unit component, which the listener wears on the head. The headphone is equipped with at least a directional angle detection sensor used for the directional angle difference detection means, an elevation angle detection sensor used for the elevation angle difference detection means, and an operation portion of the angle range setting means. When the headphone is used as the main unit component, any sound sources may be indicated by a turn or elevation of the listener's head. Accordingly, the sound volume of a desired virtual sound source may be increased or decreased only by turning the head toward a virtual sound source the listener wants to hear and tilting the head upward or downward. In addition, the range-control switch provided in the headphone makes it possible to increase the sound volume by operating the range-control switch with a motion of putting the listener's hand over the ear to listen intensively. Therefore, the sound volume may be controlled with natural movements.

Preferably, the operation unit may be constituted from a remote controller as a main unit component, which the listener holds by hand for operation. The remote controller is equipped with at least the directional angle detection sensor used for the directional angle difference detection means, the elevation angle detection sensor used for the elevation angle difference detection means, and the operation portion of the angle range setting means. With such operation unit, listeners may indicate a directional angle or an elevation angle using the remote controller, thus easily mixing without caring about the head position.

It is arbitrary what kind of sensor is used as the directional angle detection sensor and the elevation angle detection sensor. For example, when an electronic compass, a gyro sensor, a tilt sensor capable of detecting a tilt angle in triaxial directions, or an acceleration sensor is employed, the directional angle detection sensor and the elevation angle detection sensor may be constituted from one sensor component, thereby reducing the number of parts.

The mixing method according to the present invention comprises the following two steps. The first step is to detect a directional angle difference between a predetermined reference directional angle and an indicated directional angle which the listener determines by indicating with an operation unit a certain direction within a virtual sound source space where the plurality of virtual sound sources exist. The next step of mixing is to mix the plurality of audio signals supplied from the plurality of audio signal channels without adjustment and to output the mixed audio signal when the directional angle difference is zero degrees. When the directional angle difference is other than zero degrees, a state is created where the plurality of virtual sound sources are fixedly located with respect to the reference directional angle, and the plurality of audio signals supplied from the plurality of audio signal channels are mixed by performing sound volume adjustment and phase adjustment for the audio signals so that the sound volumes of one or more of the virtual sound sources located in a direction of the indicated directional angle may be higher than those of the one or more virtual sound sources at the time that the directional angle difference is zero degrees, and the mixed audio signal is outputted.

The mixing method may further comprise the step of setting a given directional angle range centering on the indicated directional angle. In the step of mixing, once the directional angle range has been set, the sound volume adjustment for the plurality of audio signals supplied from the plurality of audio signal channels is performed so that the sound volumes of one or more of the virtual sound sources located within the directional angle range may be higher than those of the one or more of the virtual sound sources when the directional angle difference is zero degrees, and that the sound volumes of other virtual sound sources located out of the directional angle range may be lower than those of the one or more of the virtual sound sources located within the directional angle range.

The mixing method according to the present invention may further comprise the step of detecting an elevation angle difference. In this step, an elevation angle of the operation unit at the time that the reference directional angle is determined is defined as a reference elevation angle, and a difference between the reference elevation angle and an elevation angle of the operation unit is detected as an elevation angle difference, and outputted. The elevation angle is defined as a positive angle when the elevation angle is formed as the operation unit is directed upward from a posture with which the reference directional angle has been determined, and defined as a negative angle when the elevation angle is formed as the operation unit is directed downward from the posture. Then, in the step of mixing, the sound volume adjustment is performed for a plurality of audio signals supplied from a plurality of audio signal channels respectively associated with a plurality of virtual sound sources located in the direction of the indicated directional angle so that, when a positive elevation angle difference is being detected, the sound volumes of the plurality of virtual sound sources located in the direction of the indicated directional angle may be increased in proportion to the elevation angle difference, and when a negative elevation angle difference is being detected, the sound volumes of the plurality of virtual sound sources located in the direction of the indicated directional angle may be decreased in proportion to the elevation angle difference.

A computer program which is installed in a computer to implement the present invention causes the computer to perform the following steps: detecting a directional angle difference between a predetermined reference directional angle and an indicated directional angle which the listener determines by indicating with an operation unit a certain direction within a virtual sound source space where the plurality of virtual sound sources exist; setting a given directional angle range centering on the indicated directional angle; defining as a reference elevation angle an elevation angle of the operation unit when the reference directional angle is determined, detecting a difference between the reference elevation angle and an elevation angle of the operation unit as an elevation angle difference, and outputting the elevation angle difference, and doing mixing as described below. In the step defining an elevation angle of the operation unit, the elevation angle is a positive angle when the elevation angle is formed as the operation unit is directed upward from a posture with which the reference directional angle has been determined, and is a negative angle when the elevation angle is formed as the operation unit is directed downward from the posture. In the step of mixing, the plurality of audio signals supplied from the plurality of audio signal channels are mixed without adjustment and the mixed audio signal is outputted when the directional angle difference is zero degrees. When the directional angle difference is other than zero degrees, a state is created where the plurality of virtual sound sources are fixedly located with respect to the reference directional angle, and the plurality of audio signals supplied from the plurality of audio signal channels are mixed by performing sound volume adjustment and phase adjustment for the audio signals so that the sound volumes of one or more of the virtual sound sources located in a direction of the indicated directional angle may be higher than those of the one or more virtual sound sources at the time that the directional angle difference is zero degrees, and the mixed audio signal is outputted. Once the directional angle range has been set, the sound volume adjustment for the plurality of audio signals supplied from the plurality of audio signal channels is performed so that the sound volumes of one or more of the virtual sound sources located within the directional angle range may be higher than those of the one or more of the virtual sound sources when the directional angle difference is zero degrees, and that the sound volumes of other virtual sound sources located out of the directional angle range may be lower than those of the one or more of the virtual sound sources located within the directional angle range. Further, the sound volume adjustment for the plurality of audio signals supplied from the plurality of audio signal channels respectively associated with the plurality of virtual sound sources located in a direction of the indicated directional angle is performed so that, when a positive elevation angle difference is being detected, the sound volumes of the plurality of virtual sound sources located in the direction of the indicated directional angle may be increased in proportion to the elevation angle difference, and when a negative elevation angle difference is being detected, the sound volumes of the plurality of virtual sound sources located in the direction of the indicated directional angle may be decreased in proportion to the elevation angle difference.

BEST MODE FOR CARRYING OUT THE INVENTION

Embodiments of the present invention will now be described in detail hereinbelow by referring to the accompanying drawings.

Figure 1:
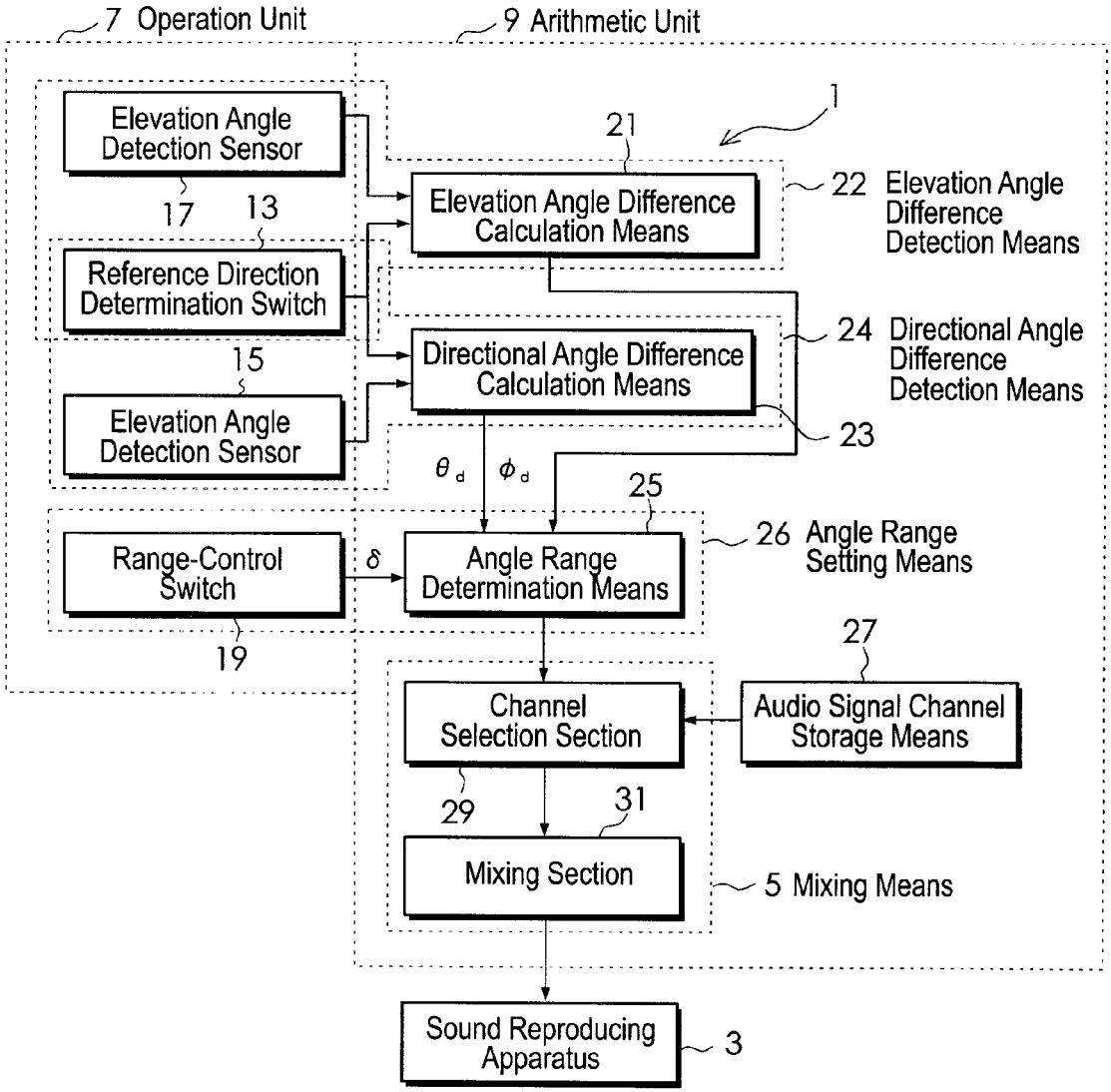
FIG. 1 is a block diagram showing an example schematic configuration of a mixing system to implement a mixing method of the present invention.

FIG. 1 is a block diagram showing an example of schematic configuration of a mixing system to implement a mixing method of the present invention. A mixing system 1 of the present embodiment includes mixing means 5 for mixing a plurality of audio signals and outputting a mixed audio signal to a sound reproducing apparatus 3 which produces a plurality of virtual sound sources around a listener. The plurality of audio signals are supplied from a plurality of audio signal channels respectively associated with the plurality of virtual sound sources. The sound reproducing apparatus 3 described here is what is called audio equipment, which is a publicly known apparatus capable of creating a plurality of virtual sound sources in a three-dimensional space around the listener. The mixing system 1 further includes an operation unit 7 operated by the listener and an arithmetic unit 9. The operation unit 7 includes at least a reference direction determination switch 13, a directional angle detection sensor 15, an elevation angle detection sensor 17, and a range-control switch 19. The arithmetic unit 9 includes elevation angle difference calculation means 21, directional angle difference calculation means 23, angle range determination means 25, and audio signal channel storage means 27 in addition to the above-mentioned mixing means 5. The mixing means 5 is constituted from a channel selection section 29 and a mixing section 31. The principal part of the arithmetic unit 9 is implemented by a computer. In the present embodiment, the main unit component of the operation unit 7 is a headphone which the listener wears on the head.

The reference direction determination switch 13 is mounted onto the headphone and works as a switch to be operated by the listener at the time of mixing. For example, when the reference direction determination switch 13 is operated at the time certain music is being played by the sound reproducing apparatus 3, an angle then detected by the directional angle detection sensor 15 is stored, as a reference directional angle for the reference direction, in an internal memory of the directional angle difference calculation means 23. Also, when the reference direction determination switch 13 is operated, an elevation angle Φ detected by the elevation angle detection sensor 17 is stored, as a reference elevation angle for the reference direction, into an internal memory of the elevation angle difference calculation means 21.

After the reference direction determination switch 13 is operated, an indicated directional angle θ detected by the directional angle detection sensor 15 in a given sampling period is inputted into the directional angle difference calculation means 23. The directional angle difference calculation means 23 calculates a directional angle difference θd, namely, a difference (θd) between the predetermined reference directional angle and the output (the detected indicated directional angle) from the directional angle detection sensor 15 that detects the direction of the headphone which the listener wears on the head. According to the present embodiment, directional angle difference detection means 24 is constituted from the reference direction determination switch 13, the directional angle detection sensor 15 and the directional angle difference calculation means 23. The directional angle difference detection means 24 detects the directional angle difference θd between the reference directional angle and the indicated directional angle θ. Here, the indicated directional angle θ is an angle which the listener determines by indicating with the operation unit 7 a certain direction within a virtual sound source space where the plurality of virtual sound sources are reproduced by the sound reproducing apparatus 3 and virtually exist in front of the listener.

After the reference direction determination switch 13 is operated, as well, the elevation angle Φ detected by the elevation angle detection sensor 17 in a given sampling period is inputted into the elevation angle difference calculation means 21. The elevation angle difference calculation means 21 calculates an elevation angle difference Φd, namely, a difference (Φd) between the predetermined reference elevation angle for the reference direction and the output (the detected elevation angle) from the elevation angle detection sensor 17 that detects the elevation angle of the headphone the listener wears on the head. According to the present embodiment, elevation angle difference detection means 22 is constituted from the reference direction determination switch 13, the elevation angle detection sensor 17 and the elevation angle difference calculation means 21. The elevation angle difference detection means 22 first defines the reference elevation angle on the basis of an elevation angle of the operation unit 7 at the time that the reference directional angle is defined, then detects a difference between the reference elevation angle and the elevation angle of the operation unit 7 as the elevation angle difference Φd. When the operation unit 7 is directed upward from a posture with which the reference directional angle has been determined, the elevation angle difference detection means 22 outputs a value of the elevation angle difference detected at that time as a positive one. When the operation unit 7 is directed downward from the posture, a value of the elevation angle difference detected at that time is outputted as a negative one.

The output value Φd outputted from the elevation angle difference calculation means 21 and the output value θd outputted from the directional angle difference calculation means 23 are inputted into the angle range determination means 25. The angle range determination means 25 sets up a specified directional angle range centering on the indicated directional angle θ indicated by the operation unit 7. The angle range determination means 25 sets up the directional angle range in accordance with a command from the range-control switch 19 mounted onto the operation unit 7. According to the present embodiment, directional angle range setting means 26 is constituted from the angle range determination means 25 and the range-control switch 19. When a command is not actively inputted from the range-control switch 19, the directional angle range setting means 26 directly outputs the output value Φd of the elevation angle difference calculation means 21 and the output value θd of the directional angle difference calculation means 23 to the channel selection section 29 of the mixing means 5 without adjustment.

When the output value Φd of the elevation angle difference calculation means 21 and the output value θd of the directional angle difference calculation means 23 are directly inputted into the channel selection section 29 without adjustment, the mixing means 5 mixes the plurality of audio signals supplied from the plurality of audio signal channels of the audio signal channel storage means 27, by performing sound volume adjustment and phase adjustment for the audio signals, and outputs the mixed audio signal as specifically described hereinbelow. For example, it is considered that the output value θd outputted from the directional angle difference calculation means 23 is inputted into the mixing means 5 on an assumption that the elevation angle difference Φd from the elevation angle difference calculation means 21 is zero degrees. When the directional angle difference is zero degrees, the channel selection section 29 supplies all the plurality of audio signals supplied from the plurality of audio signal channels directly to the mixing section 31 without adjustment.

When the directional angle difference θd is other than zero degrees, the mixing means 5 creates a state where the plurality of virtual sound sources are fixedly located with respect to the reference directional angle. Namely, output balance between left and right speakers of the headphone is adjusted to fixedly locate the plurality of virtual sound sources in the same position within the virtual space so that the location of the virtual sound sources would not move even when the head of the listener wearing the headphone of the operation unit 7 turns. Detailed description will be omitted here since the technology of fixing sound sources has been disclosed in publicly known documents such as Japanese Patent Application Publication No. 02-25900 (Patent Reference 3). The channel selection section 29 selects one or more virtual sound sources located in a direction of the indicated directional angle specified by the directional angle difference θd, and outputs a command to specify the selected one or more virtual sound sources to the mixing section 31. More specifically, once the directional angle range has been set, the channel selection section 29 calculates a directional angle difference θn' between the indicated directional angle and a directional angle θn of each of the plurality of virtual sound sources as described later, and selecting one or more of the audio signal channels respectively associated with one or more of the virtual sound sources located within the directional angle range based on the calculated directional angle differences θn'. The mixing section 31 mixes the plurality of audio signals supplied from the plurality of audio signal channels by performing sound volume adjustment for the audio signals so that the sound volumes of one or more of the audio signals supplied from the one or more of the audio signal channels which have been selected by the channel selection section 29 may be higher than those of the other audio signal channels which have not been selected. As well, the mixing section 31 performs mixing so that the sound volumes of the audio signals of the one or more virtual sound sources selected by the channel selection section 29 may be higher than the sound volumes of the audio signals of the one or more virtual sound sources at the time that the directional angle difference θd is zero degrees, and the sound volumes of the other virtual sound sources may be remained as they are (or reduced to zero-volume). What is necessary for increasing the sound volume of a virtual sound source is just to increase the amplification factor of the audio signal supplied from the selected channel. How much the amplification factor should be increased may be determined arbitrarily.

In this manner, when the listener points out a certain direction within the virtual sound source space where the plurality of virtual sound sources exist, using the operation unit 7, the directional angle difference detection means 24 detects a directional angle difference between the indicated directional angles θ and the reference directional angle. Then the mixing means 5 creates a state where the plurality of virtual sound sources are fixedly located with respect to the reference directional angle, and adjusts the sound volumes of the one or more of the virtual sound sources located in a direction determined by the indicated directional angle θ, which is indicated with the operation unit, so that the sound volumes thereof may be higher than those of the one or more virtual sound sources at the time that the directional angle difference is zero degrees. In this manner, the listener may easily increase the sound volume of a particular virtual sound source located in a direction indicated by the listener, a part (musical instrument) the listener wants to hear, without moving the location of the plurality of virtual sound sources. As a result, even listeners who are not familiar with mixing techniques may freely control the sound volume of a specified part (virtual sound source) merely by pointing to an appropriate direction using the operation unit 7. To decrease the sound volume, what is necessary is just to change the indicated directional angle, which is indicated by the operation unit 7, to another direction (for example, to the direction of the reference directional angle).

Next, it is considered that the elevation angle difference, which is outputted from the elevation angle difference calculation means 21 and inputted into the angle range determination means 25, is varied on an assumption that the directional angle difference outputted from the directional angle difference calculation means 23 is fixed. When the operation unit 7 is directed upward (when the listener's head is directed upward) from a posture with which the reference directional angle has been determined, the elevation angle difference detection means 22 outputs a value of the elevation angle difference detected at that time as a positive elevation angle difference +Φd. When the operation unit 7 is directed downward from the posture (when the listener's head is directed downward), the elevation angle difference detection means 22 outputs a value of the elevation angle difference detected at that time as a negative elevation angle difference −Φd. Likewise, the channel selection section 29 selects a plurality of audio signal channels of a plurality of virtual sound sources located in the direction of the indicated directional angle θ, which is determined on the basis of the directional angle difference θd calculated by the directional angle difference calculation means 23. When the elevation angle difference detection means outputs a positive elevation angle difference +Φd, for example, the mixing section 31 adjusts the sound volumes of the plurality of virtual sound sources located in the direction of the indicated directional angle θ so that they may be increased as their locations go away from the operation unit 7 in proportion to the magnitude of the elevation angle difference +Φd. As well, when the elevation angle difference detection means 22 outputs a negative elevation angle difference −Φd, the mixing section 31 adjusts the sound volumes of the plurality of virtual sound sources located in the direction of the indicated directional angle θ so that they may be decreased as their locations go away from the operation unit 7 in proportion to the magnitude of the elevation angle difference −Φd. In this manner, the sound volumes of the plurality of virtual sound sources located in the direction of the indicated directional angle θ may be selectively increased or decreased by changing the elevation angle of the operation unit 7. That makes it possible to intensively listen to the sound of a specific virtual sound source.

Generally, since both of the output value Φd of the elevation angle difference calculation means 21 and the output value θd of the directional angle difference calculation means 23 are inputted into the angle range determination means 25, sound volumes of the plurality of virtual sound sources located in the direction determined by the indicated directional angle are selectively increased or decreased on the basis of the two outputs, θd and Φd.

When a command to set a directional angle range is inputted into the angle range determination means 25 from the range-control switch 19, the angle range determination means 25 controls the directional angle range on the basis of both of the output Φd from the elevation angle difference calculation means 21 and the output θd from the directional angle difference calculation means 23. The mixing means 5 then adjusts the sound volumes of one or more virtual sound sources located within the set-up directional angle range so that they may be higher than the sound volumes at the time that the directional angle difference is zero degrees. Simultaneously, the mixing means 5 adjusts the sound volumes of the plurality of audio signals supplied from the plurality of audio signal channels so that the sound volumes of the other virtual sound sources located out of the directional angle range may be lower than that of the one or more virtual sound sources located within the directional angle range.

The angle range determination means 25 narrows the directional angle range when the range-control switch 19 is operated in a closing direction, and expands the directional angle range when the range-control switch 19 is operated in an opening direction. For example, the value of α in expression of θd (directional angle difference) ±α is determined in proportion to how much the range-control switch 19 is operated. When the range-control switch 19 is not operated, the value α is not determined in particular, and all sounds from all the virtual sound sources are audible centering on the indicated direction. When the range-control switch 19 is operated, the value of α is set smaller in proportion to (in inverse proportion to) how much the range-control switch 19 is operated. Only the sound volumes for the audio signals of the virtual sound sources located within the directional angle range are increased. The sound volumes for the audio signals of the other virtual sound sources located out of the directional angle range are decreased.

The more the range-control switch 19 is operated, the smaller the value of α becomes. Accordingly, only the sound volumes of the virtual sound sources located within the narrowed range determined by the directional angle difference $\theta d \pm \alpha$ and the elevation angle difference $\Phi d$ are increased, and those of the other virtual sound sources located out of that range are decreased. With such range-control switch 19 provided, the directional angle range may be narrowed down just by operating the range-control switch 19, thereby simplifying sound volume adjustment for a specific virtual sound source. Preferably, this range-control switch 19 is configured to be automatically operated in the opening direction, typically using a spring mechanism. With such spring mechanism provided, what is necessary for setting the range-control switch 19 in a fully opening position is just to release the switch, thereby simplifying the operation. A range-control switch 19 typically includes those which have a built-in a force sensor or a bending sensor that measures a force $\delta$ (bending strength proportional to the amount of operation) applied to an operation lever of the range-control switch 19. As a detecting element for the range-control switch, it is also possible to employ a sensor, which is constituted from a combination of a variable resister and a control lever and is configured to measure how much the operation lever is operated, based on the position of a slider of the variable resister. Sensors for measuring the amount of operation are not limited in particular, and various sensors may be employed, of course.

Figure 2:
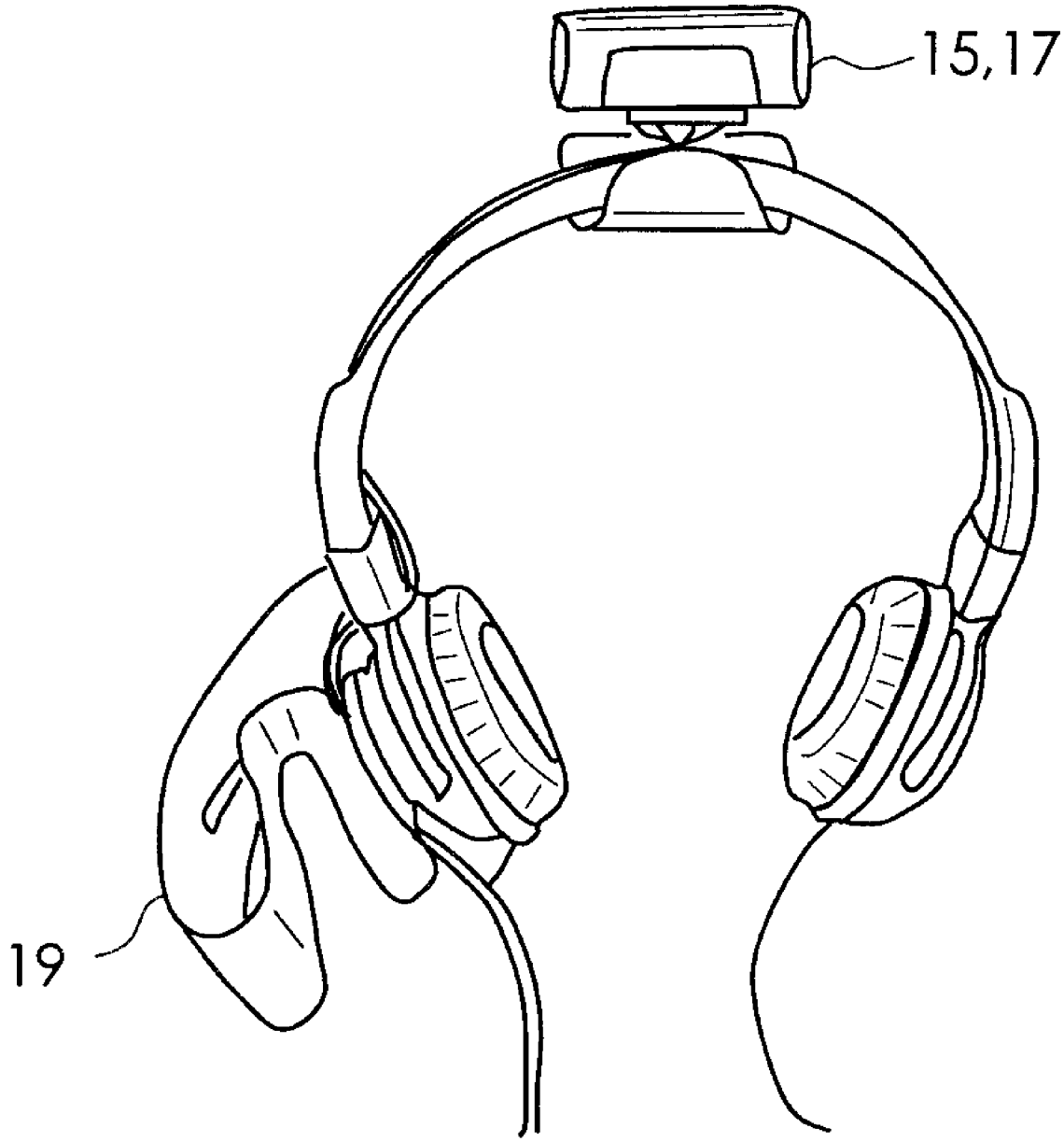
FIG. 2 illustrates an actually-used headphone equipped with sensors.

FIG. 2 illustrates an actually-used headphone equipped with sensors. Reference numerals are given to where the range-control switch 19, the directional angle detection sensor 15 and the elevation angle detection sensor 17 are disposed. As illustrated herein, when a headphone is used as the main unit component of the operation unit 7, a particular sound source may be indicated just by a turn or elevation of the listener's head. Accordingly, the sound volume of a desired virtual sound source may be increased or decreased only by turning the head toward a virtual sound source which the listener wants to hear and tilting the head upward or downward. In addition, the range-control switch 19 provided in the headphone makes it possible to increase the sound volume by operating the range-control switch 19 with a motion of putting the listener's hand over the ear as if listening intensively. In this manner, the sound volume may be controlled with human natural motions.

It is arbitrary what kinds of sensors are employed as the directional angle detection sensor 15 and the elevation angle detection sensor 17. For example, when an electronic compass, a gyro sensor, a tilt sensor capable of detecting a tilt angle in triaxial directions, or an acceleration sensor is employed, the directional angle detection sensor 15 and the elevation angle detection sensor 17 may be constituted from one sensor component, thereby reducing the number of components.

Next, a method and a computer program for specifically implementing the above-mentioned embodiments using a personal computer will be explained hereinbelow. In the following description, the directional angle detection sensor 15 and the elevation angle detection sensor 17 are constituted by an electronic compass. In one embodiment described below, an angular difference (directional angle difference) between the position of a sound source (position of a virtual sound source) and the front direction that the listener's head faces is measured with the electronic compass so that the sound volume and phase (sound volume ratio for sounds audible from left and right) for each sound source may be changed according to the angular difference. Then the elevation angle of the listener's head is measured with the electronic compass so that the mixing sound volume of a distant sound source may be higher and the mixing sound volume of a nearby sound source may be lower as the elevation angle becomes larger. The bending sensor (a sensor mounted onto the range-control switch 19) attached to the headphone detects a motion of the listener's hand around the ear to change the directivity. When the range-control switch 19 is bent, the mixed sound volume of a sound source located in the front direction becomes higher, and the mixed sound volume for the other sound sources located in the left, right and rear directions with respect to the listener become lower.

Figure 3:
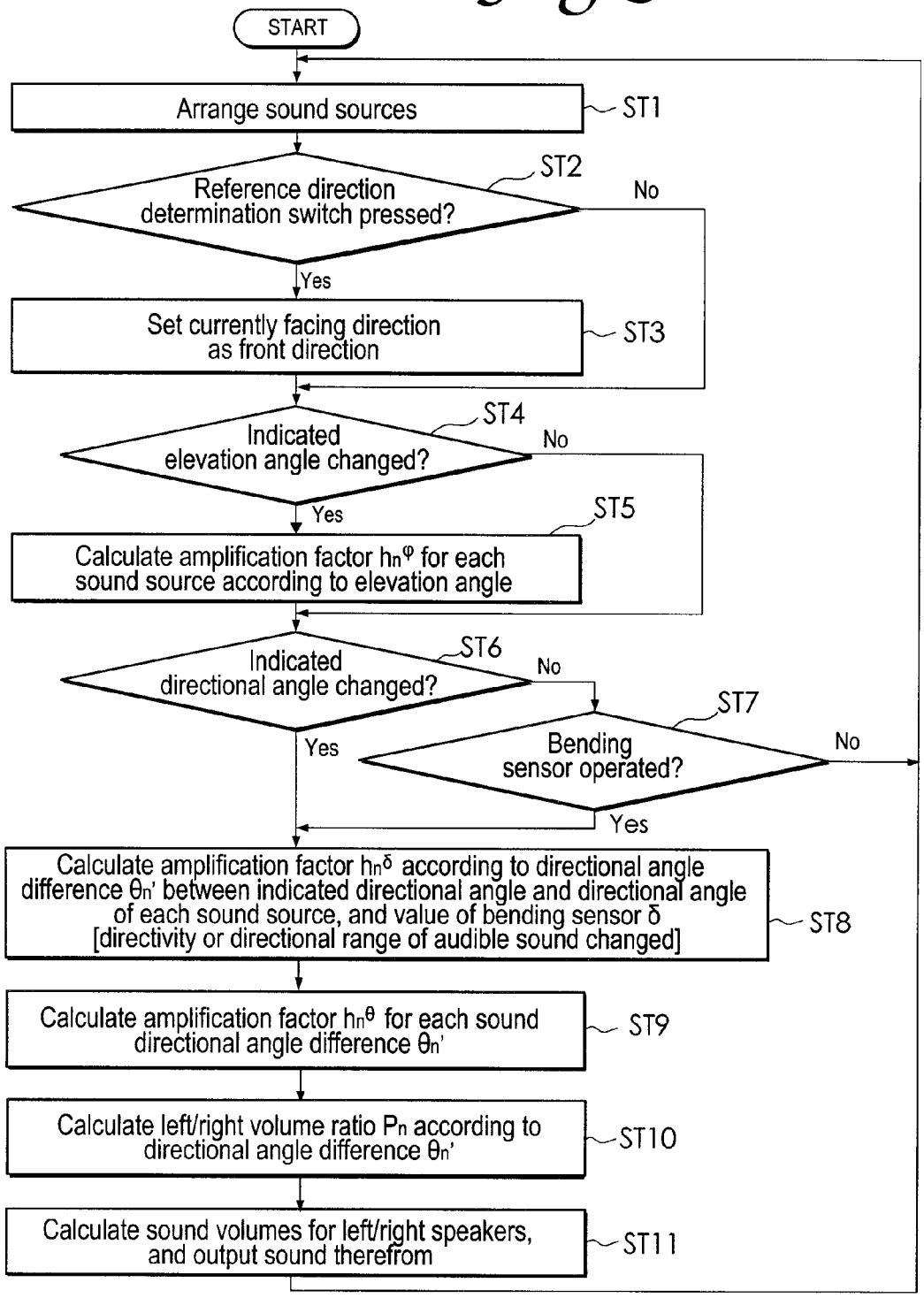
FIG. 3 is a flowchart showing an algorithm of a computer program installed in a computer in order to implement the mixing method and the mixing system of the present invention.

FIG. 3 is a flowchart showing an algorithm of a computer program installed in a computer in order to implement the method and mixing system of the present invention. Outputs (analog signals) from the directional angle detection sensor 15 and the elevation angle detection sensor 17 constituted from the electronic compass are converted into a digital form by an A/D converter and inputted into the computer. The computer calculates the positions of virtual sound sources, then mixes the audio signals of the virtual sound sources by determining the sound volume and phase adjustments of the audio signals, and outputs a mixed signal.

The electronic compass employed herein may measure the directional angle and elevation angle simultaneously, and values of the indicated directional angle $\theta$ and indicated elevation angle $\Phi$ are converted into numeric values of 0 to 127 by the A/D converter and then inputted into the computer. Hereinafter, an angle is measured in units of radian, where $-\pi \leqq \theta < \pi$ and $-\pi \leqq \Phi < \pi$ and the elevation angle $\Phi$ and the directional angle $\theta$ of a direction that the listener initially faces are defined as zero radians. Namely, the indicated elevation angle $\Phi$ and indicated directional angle $\theta$ are respectively identical to the values of elevation angle difference $\Phi d$ and directional angle difference $\theta d$, which are the differences from the above-mentioned reference directional angle.

Outputs of the bending sensor provided in the range-control switch 19 are also converted into numeric values of 0 to 127 by the A/D converter and inputted into the computer. The intensity of bending is normalized from 0 to 1 in the computer. The bending strength is normalized in the range of $0 \leqq \delta \leqq 1$, where "0" means that the lever is not bent at all and "1" means that the lever is fully bent.

Audio signals from a plurality of audio channels, which have been obtained by recording respective parts' sounds, are used as sound sources. In the following description, audio channels are associated with the respective recorded sound parts. Sound sources are adjusted at the same signal level in advance. In the following description, signals from the respective sound sources are denoted by "Sn". The letter "n" in the "Sn" means that the signal "Sn" is the $n^{th}$ audio signal.

Figure 4:
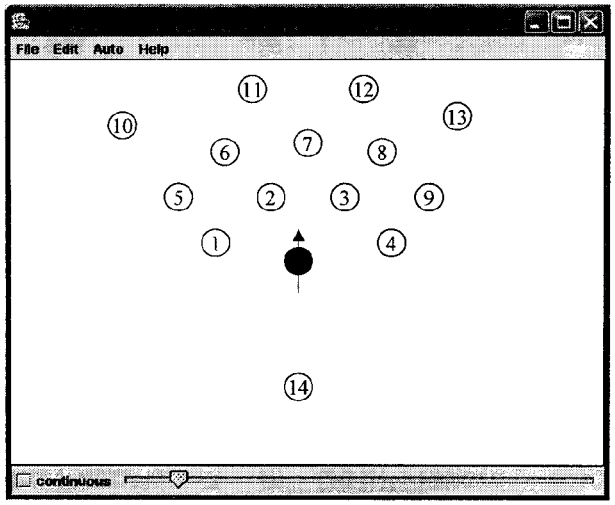
FIG. 4 is an example layout illustrating a situation where a listener is located in the conductor's position for a classical orchestra.

In this example, the sound sources are located in a two-dimensional virtual space for easy visual confirmation. Several kinds of layouts may be prepared and replaced with each other. For example, FIG. 4 shows an example layout illustrating a situation where a listener is located in the conductor's position of a classical orchestra. Circled numbers in FIG. 4 represent the respective virtual sound sources of the following musical instruments:

1: First Violin, 2: Second Violin, 3: Cello, 4: Viola, 5: Harp, 6: Horn, 7: Clarinet, 8: Oboe, 9: Contrabass, 10: Percussion, 11: Trumpet, 12: Trombone, 13: Tuba, 14: Audience Voice or Applause.

Figure 5:
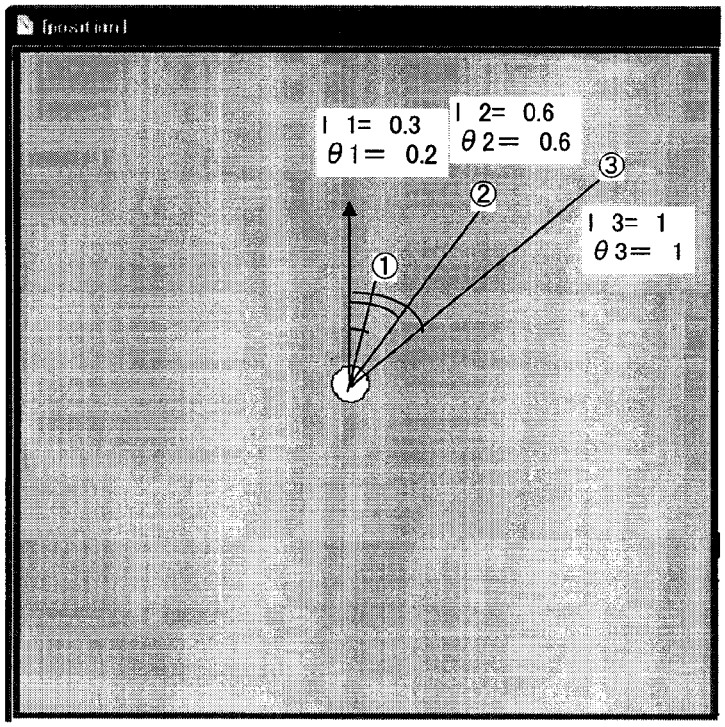
FIG. 5 is an imaginary illustration of normalization.

In FIG. 4, the black circle ● represents the listener's position, and an arrow indicates direction that the listener is facing now (indicated directional angle). The distance from each virtual sound source to the center (the listener's position) is denoted by "ln", and the directional angle for the position of each virtual sound source is denoted by $\theta n$. There is no unit for "ln" since it is a relative value, and is normalized from 0 to 1 ($0 \leqq ln \leqq 1$) where the distance from the center to the outermost sound source is defined as 1. FIG. 5 is an imaginary illustration showing the above-mentioned normalization. In FIG. 5, the circled numbers ①, ② and ③ show the positions of the virtual sound sources. The central round symbol indicates the listener's position.

In practice, as shown in the layout of FIG. 4, whether the arrangement of the virtual sound sources is good or bad has an effect on the quality of mixing. Arrangement of the sound sources is determined when creating a plurality of audio signal channels to be used. In the flowchart of FIG. 3, "Arrange Sound Sources" in step ST1 means that audio signals are reproduced with the sound reproducing apparatus 3 and are arranged in front of or around the listener.

In step ST2 of FIG. 3, it is determined whether or not the reference direction determination switch 13 has been pressed. if the reference direction determination switch 13 has been pressed, the direction that the operation unit 7 indicates (the direction that the listener wearing the headphone faces) is determined as the front direction (namely, the reference directional angle and reference elevation angle are determined) in step ST3. Step ST3 is performed in every initial stage. Incidentally, the reference directional angle may be modified in the course of the mixing.

Next, in step ST4, it is detected whether or not the elevation angle of the operation unit 7 has been changed in a direction determined by the indicated directional angle θ indicated by the listener with the operation unit 7. If the elevation angle Φ has been changed, the process goes to the next step, ST5. In step ST5, an elevation angle of the operation unit 7 at the time of determining the reference direction is defined as the reference elevation angle and a difference between the reference elevation angle and an elevation angle of the operation unit 7 is detected as an elevation angle difference Φd. The elevation angle difference Φd detected when the operation unit 7 is directed upward from a posture with which the reference directional angle has been defined as a positive elevation angle difference, and the elevation angle difference detected when the operation unit 7 is directed downward from the posture is defined as a negative elevation angle difference −Φd. In step ST5, an amplification factor $h_n^{\Phi}$ for each sound source is calculated in accordance with the elevation angle. Specifically, the amplification factor i.e., amplification ratio (attenuation ratio) $h_n^{\Phi}$ (where $0 \leqq h_n^{\Phi} \leqq 1$) for each sound source n is calculated in accordance with the elevation angle Φ measured by the electronic compass. The amplification factor $h_n^{\Phi}$ may be defined, for example, by the following expression (1):

$$h_n^{\phi} = 1 + l_n \sin\phi - \frac{\sum_m l_m \sin\phi}{m} \tag{1}$$

It is a function rich indicates a large value of amplification factor for a distant sound source from the listener and a small value of amplification facto for a nearby sound source when the elevation angle is positive (when the elevation angle is larger than the reference elevation angle). To the contrary, when the elevation angle is negative (when the elevation angle is smaller than the reference elevation angle), the function indicates a small value of amplification factor for a distant sound source and a large value of amplification factor for a nearby sound source from the listener. Namely, when a positive elevation angle difference Φd is being detected, the sound volumes of the plurality of virtual sound sources located in the direction of the indicated directional angle θ are increased in proportion to the elevation angle difference. In other words, the sound volume (amplification factor) of the virtual sound source is increased in proportion to the distance from the operation unit 7 to the virtual sound source concerned. When a negative elevation angle difference −Φd is being detected, the sound volumes of the plurality of virtual sound sources located in the direction of the indicated directional angle θ is decreased in proportion to the elevation angle difference Φd. In other words, the sound volume (amplification factor) of the virtual sound source is decreased in proportion to the distance from the operation unit 7 to the virtual sound source.

Figure 6A:
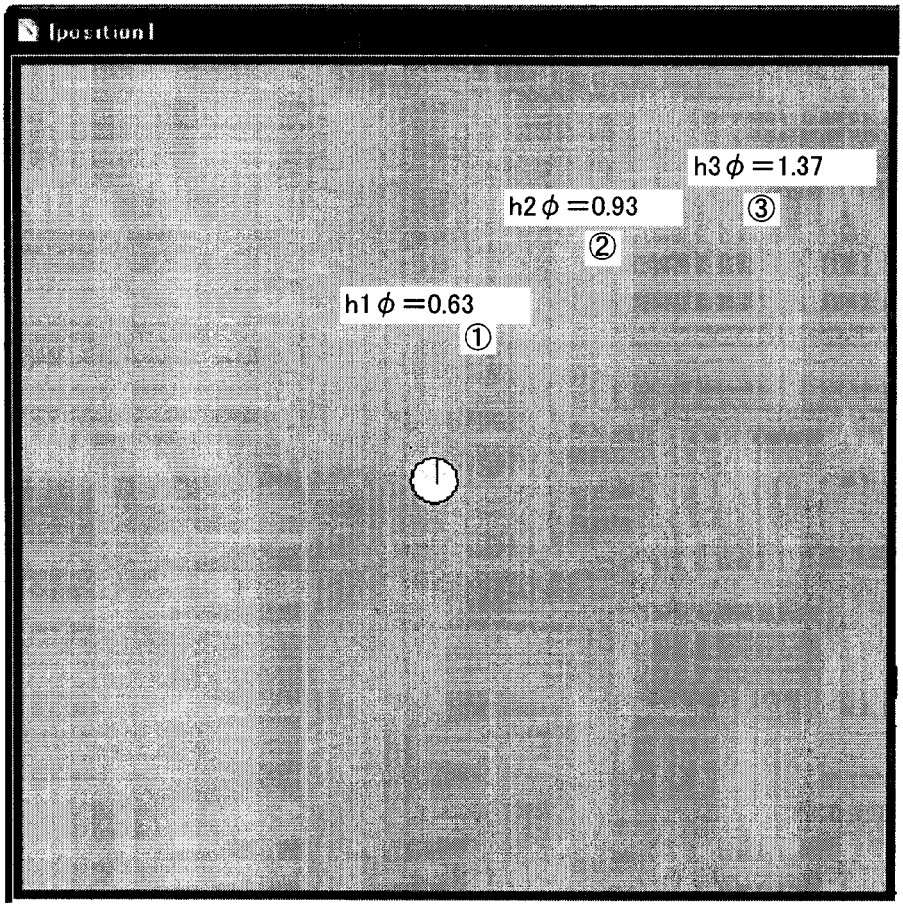
FIG. 6A illustrates the relationship of amplification factors and physical positions of the listener (operation unit) and three virtual sound sources, when a positive elevation angle difference is being detected.
Figure 6B:
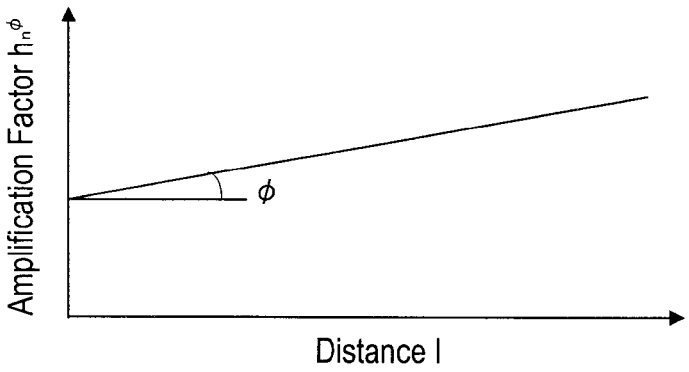
FIG. 6B is a graph showing the relationship of an amplification factor and distance, when the positive elevation angle difference is being detected.
Figure 7A:
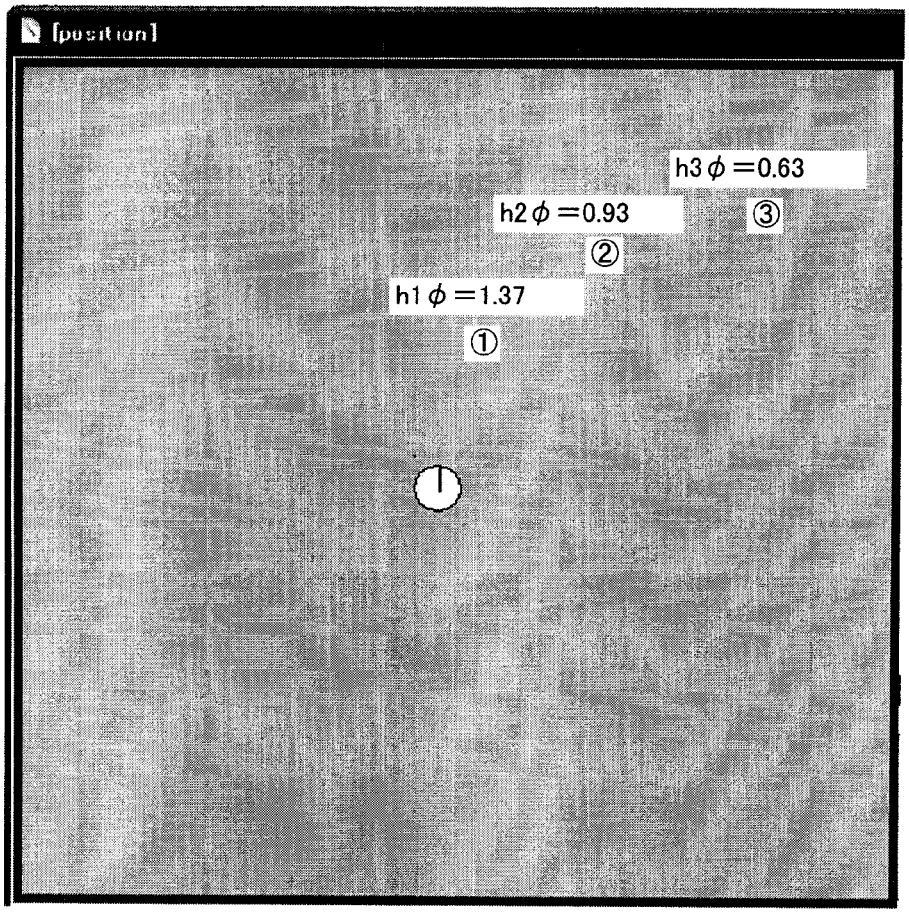
FIG. 7A indicates the relationship of amplification factors and physical positions of the listener (operation unit) and three virtual sound sources, when a negative elevation angle difference is being detected.
Figure 7B:
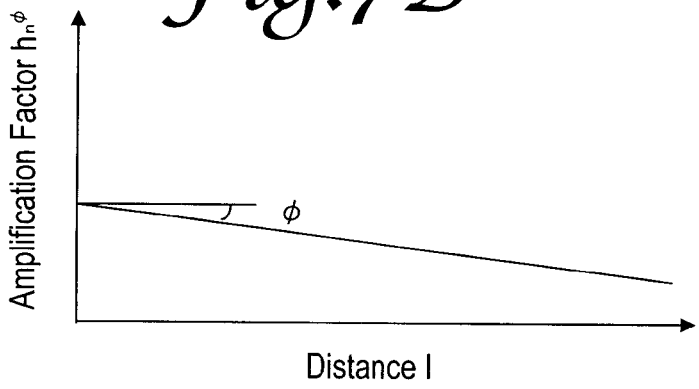
FIG. 7B is a graph showing the relationship of an amplification factor and distance, when the negative elevation angle difference is being detected.

FIG. 6A illustrates the relationship of amplification factors and physical positions of the listener (operation unit 7) and three virtual sound sources when a positive elevation angle difference is being detected. It is shown that the amplification factor $h_n^{\Phi}$ is increased more as the virtual sound source is arranged away from the operation unit (0.63→0.93→1.37). FIG. 6B is a graph showing the relationship of an amplification factor $h_n^{\Phi}$ and distance when the positive elevation angle difference is being detected. FIG. 7A illustrates the relationship of amplification factors and physical positions of the listener (operation unit 7) and the three virtual sound sources when a negative elevation angle difference is being detected. It is shown that the amplification factor $h_n^{\Phi}$ is decreased more as the virtual sound source is arranged away from the operation unit 7 (1.37→0.93→0.63). FIG. 7B is a graph showing the relationship of an amplification factor $h_n^{\Phi}$ and distance when the negative elevation angle difference is being detected.

Next, in step ST6, it is determined whether or not the directional angle indicated by the operation unit 7 has been changed. If the directional angle has been changed, the process goes to step ST8. If the directional angle is not changed, then the process goes to step ST7. In step ST7, it is be determined whether or not the range-control switch 19 is operated to adjust the directional angle range. Here, such determination is based on whether or not the bending sensor of the range-control switch 19 has been operated. In step ST7, the directional angle range to be controlled is determined based on how much the switch 19 is operated (that is, bending strength δ of the bending sensor).

In step ST7, when the range-control switch 19 is operated to adjust the closing/opening operation (to change the bending strength δ of the bending sensor), the bending strength δ of the bending sensor, which varies in proportion to the operation amount of the range-control switch 19 or how much the range-control switch is operated, is measured. In step ST8, in response to the measured bending strength δ of the bending sensor, the amplification factor $h_n^{\delta}$ for each sound source is calculated in accordance with the bending strength δ measured by the bending sensor. The amplification factor $h_n^{\delta}$ is a function having a solution of either 0 or 1. When the bending sensor is not bent, the amplification factor $h_n^{\delta}$ is 1 for all the sound sources. When the bending sensor is bent, the directional angle range is narrowed down (and directivity is accordingly changed) and the area in which the amplification factor $h_n^{\delta}$ is 1 is gradually decreased in accordance with the amount of the closing operation. When the range-control switch 19 is operated most strongly, the amplification factor of $h_n^{\delta}=1$ is shown only in the sound sources arranged in the direction of the indicated directional angle, which is determined by the listener's facing direction.

The value of the amplification factor $h_n^{\delta}$ may be defined, for example by the following expression (2):

$$h_n^{\delta} = \begin{cases} 1 & \pi(1-\delta) \geq |\theta_n'| \\ 0 & \pi(1-\delta) < |\theta_n'| \end{cases} \quad (2)$$

In the above expression, θn' (−π≦θn'<π) is an angular difference between the directional angle θn of each sound source, and the indicated directional angle θ.

Figure 8:
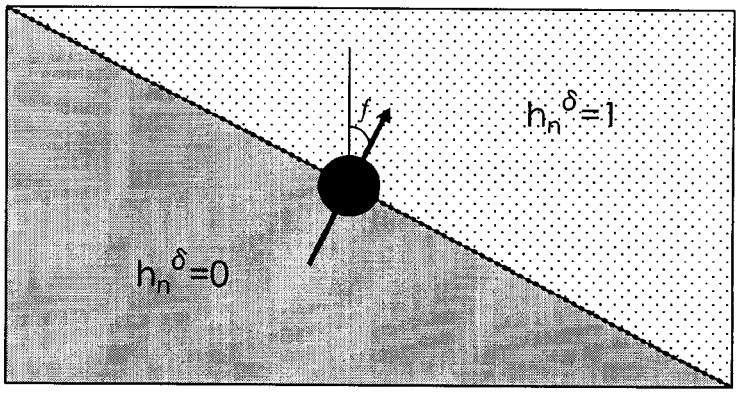
FIG. 8 illustrates an audible situation where $\theta=30°$ and $\delta=0.5$.
Figure 9:
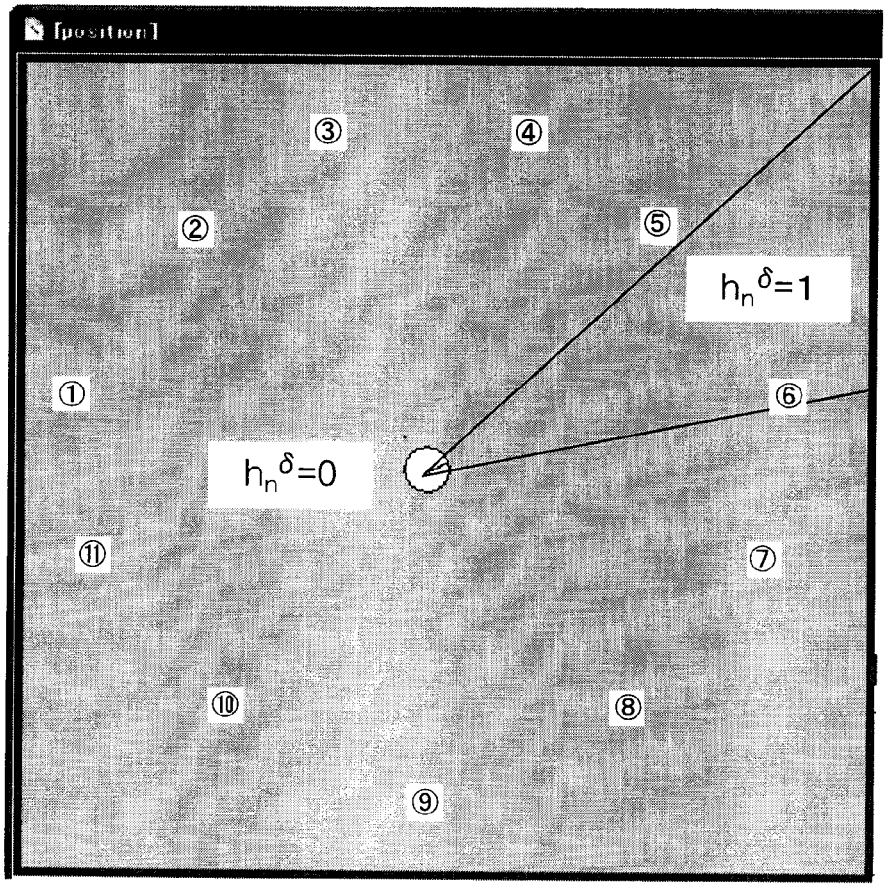
FIG. 9 illustrates an audible range when a range-control switch is strongly pressed ($\theta=30$, $\delta=0.9$) in a situation where eleven virtual sound sources are arranged around the listener.

For example, when θ=30° and δ=0.5, the sound sources arranged in the rear half around the listener take the amplification factor of $h_n^{\delta}=0$, and the sound sources arranged in the front half around the listener take the amplification factor of $h_n^{\delta}=1$, as shown in FIG. 8. In this manner, unnecessary sounds may be removed. FIG. 9 illustrates an audible range at the time that a range-control switch is strongly operated (θ=30°, δ=0.9) when eleven virtual sound sources are arranged around the listener. In this situation, only the virtual sound source ⑥ is audible and sounds from the other virtual sound sources are removed as unnecessary sounds.

Next, the process goes to step ST 9. In step ST9, the amplification factor $h_n^{\theta}$ for each sound source is calculated based on the indicated directional angle θ measured by the electronic compass. The amplification factor $h_n^{\theta}$ is a function which takes a higher value for the sound sources arranged in the direction of the indicated directional angle θ that the listener faces, and takes a lower value for the sound sources arranged in the directions other than that of the indicated directional angle. Such function may be defined, for example, by the following expression (3):

$$h_n^{\theta} = 1 - \frac{|\theta_n'|}{\pi(1-\delta)} \quad (3)$$

Figure 10:
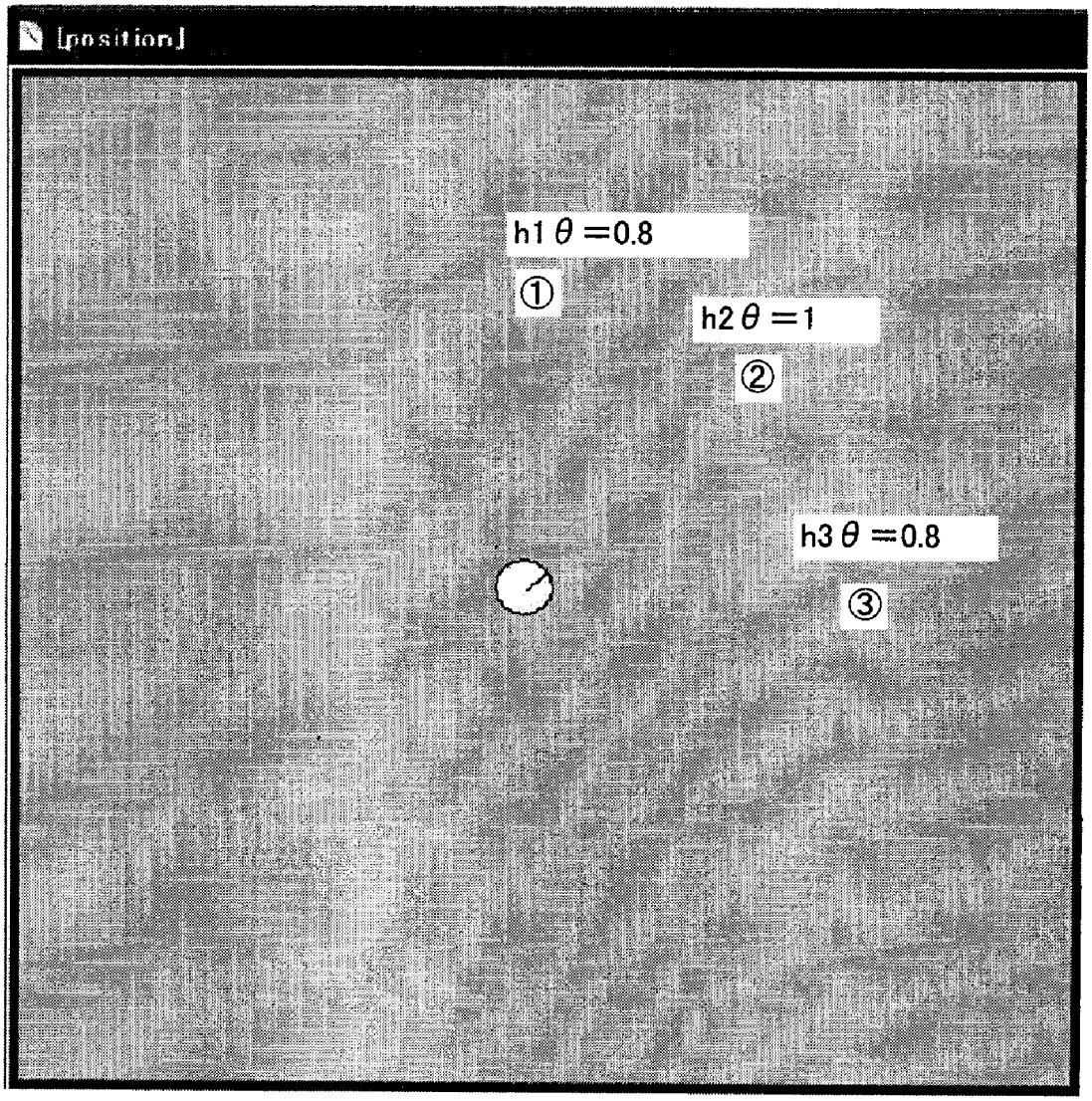
FIG. 10 shows a difference in amplification factor for each virtual sound source, which is calculated by expression (3).

In the above expression (3), the bending strength δ of the bending sensor provided in the above-mentioned range-control switch 19 is taken into consideration, and the directivity is more increased as the bending strength δ or the amount of the closing operation increases (in proportion to the bending strength or the amount of the closing operation). As a result, the sound volume of a sound source arranged in the direction of the indicated directional angle θ becomes higher. FIG. 10 illustrates a difference in amplification factor $h_n^{\theta}$ for each virtual sound source, which is defined by the above-mentioned Expression (3). As shown in FIG. 10, the amplification factor for the virtual sound source located in the direction of the indicated directional angle θ is the highest, and gradually decreases as the virtual sound sources go away from the direction of the indicated directional angle θ (in proportion to the directional angle difference between the indicated directional angle θ and directions of the neighboring virtual sound sources).

Next, the process goes to step ST10 and a left/right volume ratio Pn is calculated in accordance with the directional angle difference θn' for each sound source. Namely, phase adjustment is implemented. The left/right volume ratio Pn (0≦Pn≦1) for each sound source, is calculated according to the indicated directional angle θ measured by the electronic compass. When the localization or panpot (interaural intensity ratio) Pn for one sound source is zero, the sound volume ratio for the sound source audible from the right and left speakers is defined as 0:1. When the left/right volume ratio Pn for one sound source is 0.5, the sound volume ratio for the sound source audible from the right and left speakers is defined as 1:1. When the left/right volume ratio Pn for one sound source is 1, the sound volume ratio for the sound source audible from the right and left speakers is defined as 1:0. The left/right volume ratio is defined by the following expression (4):

$$P_n = \frac{1}{2} + \frac{\theta_n'}{\pi} \quad (4)$$

Figure 11:
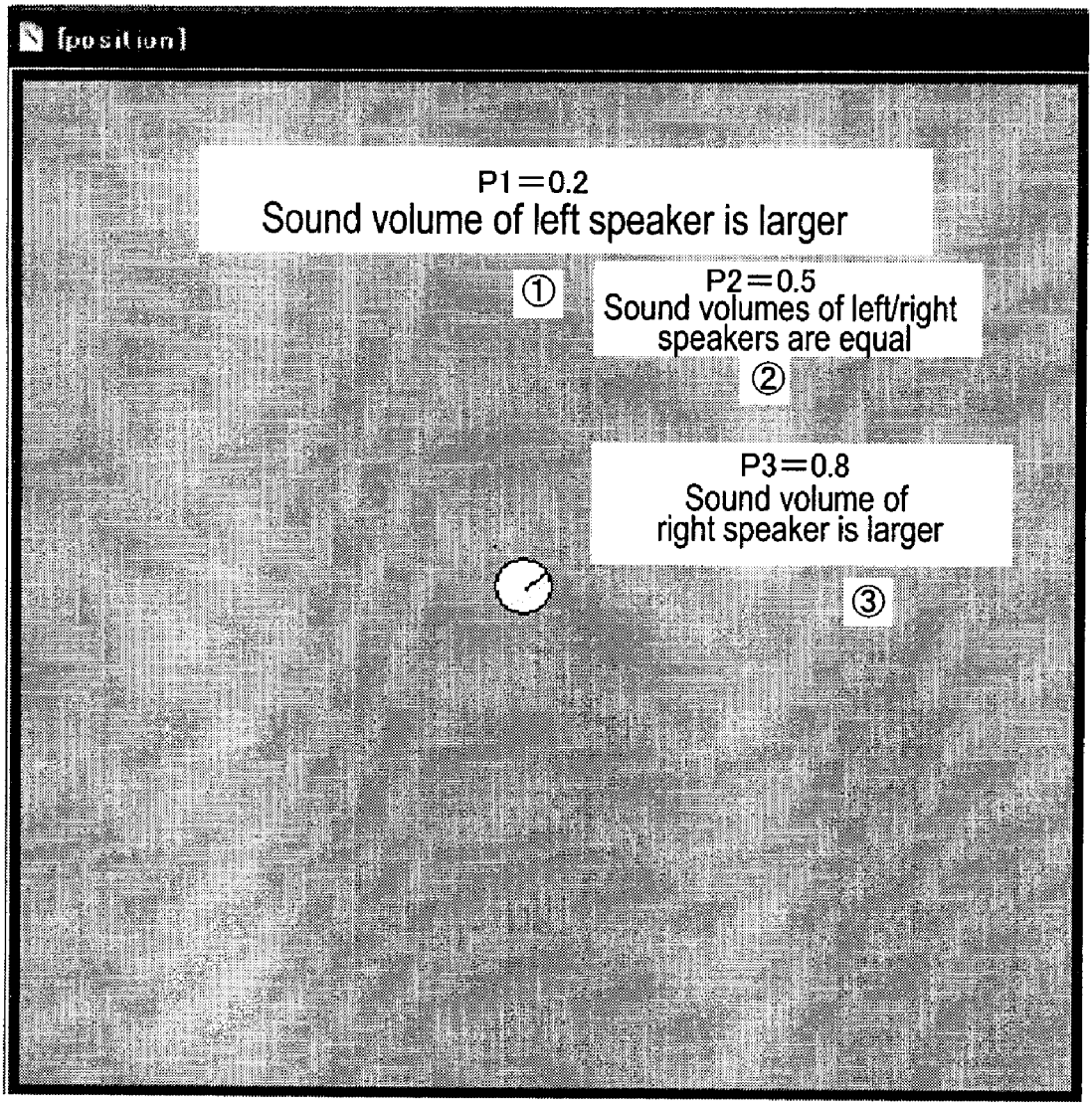
FIG. 11 shows an example of left/right volume ratio for each virtual sound source, which is calculated by expression (4).

Since phase adjustment for each sound source is implemented by defining the left/right volume ratio using the above expression (4), localizations or panpots of the virtual sound sources are fixed and do not move along with the motion of the listener's head. FIG. 11 illustrates an example left/right volume ratio for each virtual sound source, which is calculated using the above expression (4). As shown in FIG. 11, the left/right volume ratio for the virtual sound source ②, which is located in the direction of the indicated directional angle, is defined as 0.5.

Next, the sound volumes audible from the right and left speakers of the headphone are calculated in the subsequent step ST11. Namely, signals supplied from all the virtual sound sources are summed up and outputted from the headphone. At that time, all the amplification factors defined through steps ST5, ST8 and ST9 are multiplied.

The final output value on the right-side speaker is calculated by the following expression (5):

$$S_{Right} = \sum_n S_n \cdot h_n^{\phi} \cdot h_n^{\delta} \cdot h_n^{\theta} \cdot p_n \quad (5)$$

The final output value on the left-side speaker is calculated by the following expression (6):

$$S_{left} = \sum_n S_n \cdot h_n^{\phi} \cdot h_n^{\delta} \cdot h_n^{\theta} \cdot (1 - p_n) \quad (6)$$

Figure 12:
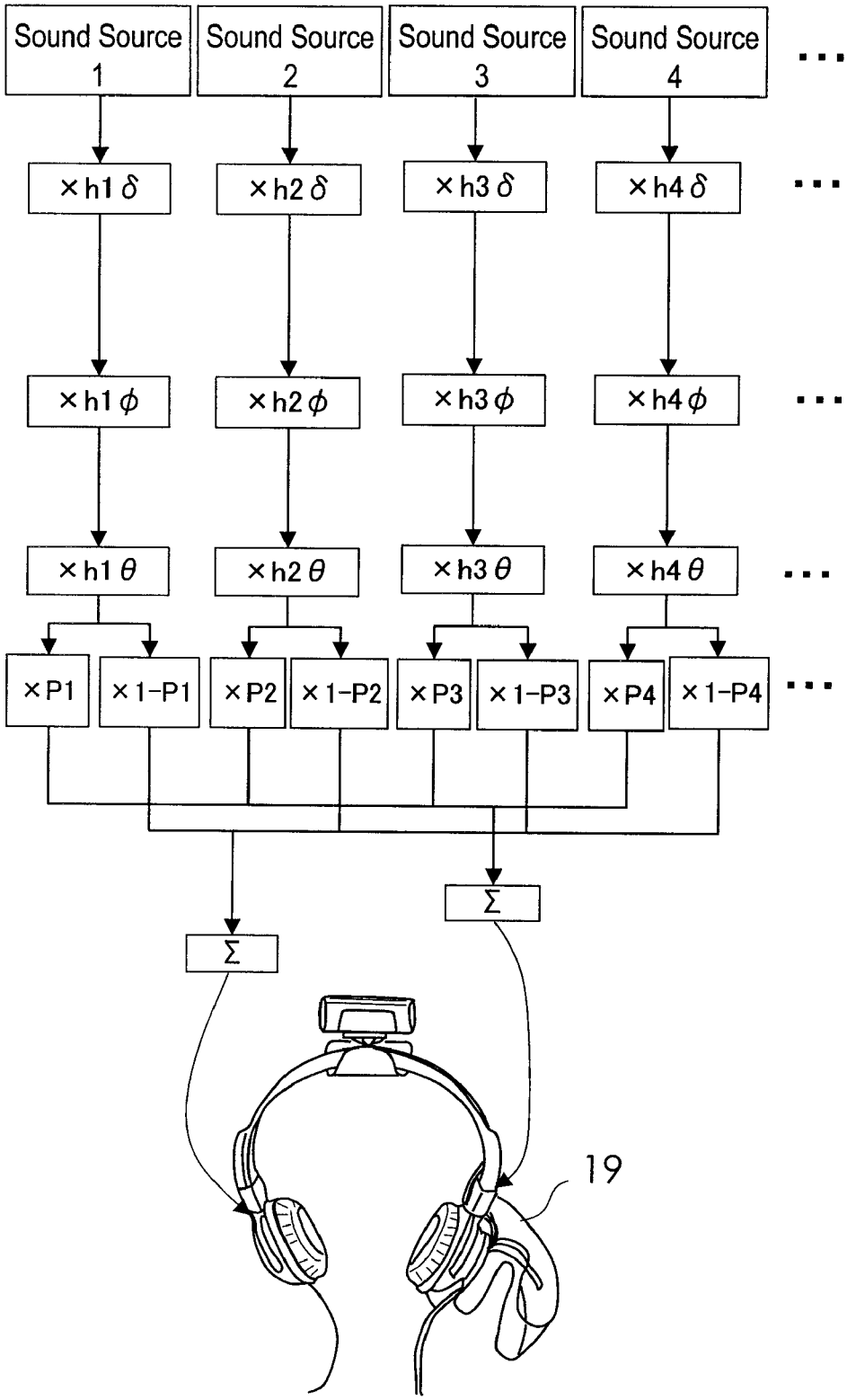
FIG. 12 is an imaginary illustration showing how the amplification factors are multiplied by mixing means.

The above calculations are implemented by the mixing means 5. FIG. 12 is an imaginary illustration showing how the amplification factors are multiplied by the mixing means. Here, three "×h1"'s shown step by step in FIG. 12 represent the respective amplification factors for the virtual sound source ①, which are obtained through the above-mentioned steps ST5, ST8 and ST9 respectively. The symbols "×" and "×1−" in the final step means that the respective values of the sound volume ratio of the right and left speakers of the headphone, as calculated in step ST10, are multipliers for the outputs from the headphone. Then, the last "Σ" means that all of the multiplied signals, which are obtained by multiplying the audio signals of the respective virtual sound sources by the amplification factors and the left/right volume ratio, are summed up for the right and left speakers respectively.

Figure 13A:
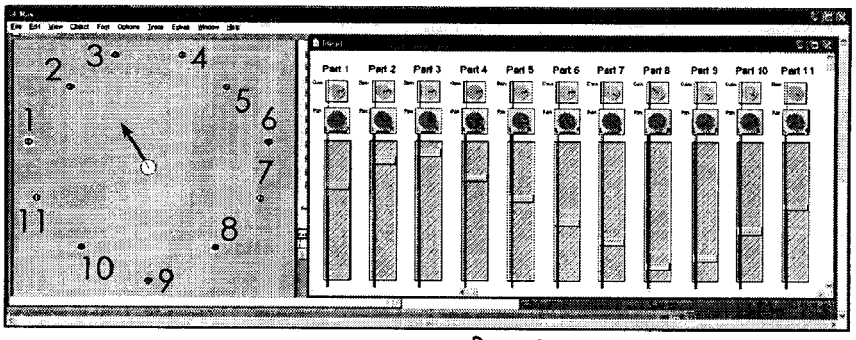
FIGS. 13A to 13C conceptually show changes in sound volume for virtual sound sources when mixing is performed using the mixing system, wherein the changes are respectively represented by amplification factor determination levers (illustrated in the right-half portions in the FIGS. A-C) of the mixing system.
Figure 13B:
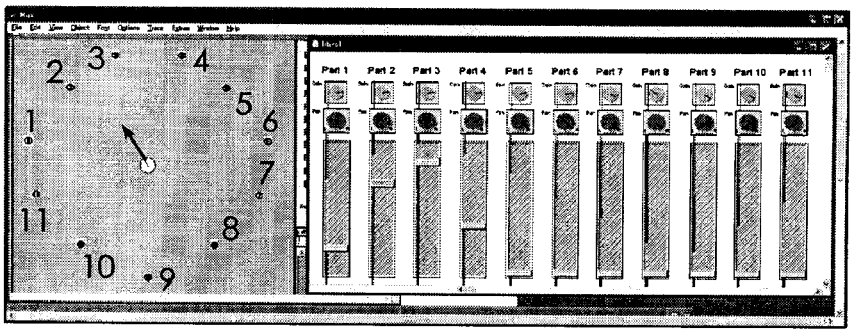
Figure 13C:
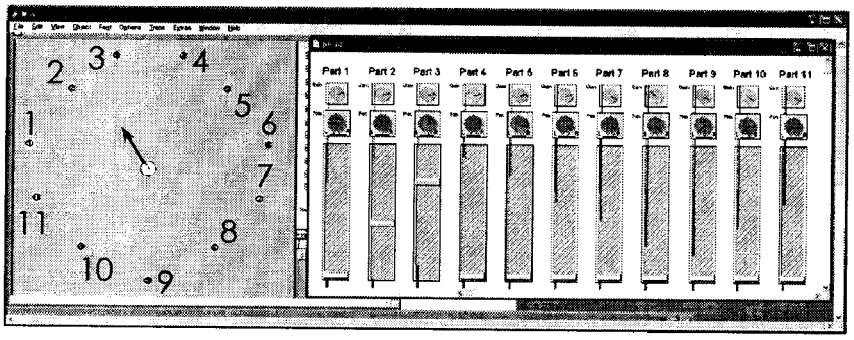

FIGS. 13A to 13C conceptually illustrate changes in sound volumes for virtual sound sources 1 to 11 (illustrated in the left-half portions of the figures) when mixing is performed using the above-mentioned mixing system. The changes are represented by up/down sliding motions of respective amplification factor determination levers of the mixing system (illustrated in the right-half portions of the figures). In those figures, levers positioned higher mean louder sound volumes. As shown in FIG. 13A, when the range-control switch 19 is not operated (δ=0), all the virtual sound sources 1 to 11 are audible. As shown in FIG. 13B, when the range-control switch 19 is softly operated (δ=0.6), those close to the virtual sound source 3 are audible. Further, as shown in FIG. 13C, when the range-control switch 19 is strongly operated, only the virtual sound sources 2 and 3 are audible. As shown in those figures, according to the present embodiment, audibility of a particular virtual sound source is controllable in accordance with the operation amount of the range-control switch 19 or how much the range-control switch is operated.

According to the above-mentioned embodiment, when the listener wearing the headphone turns right, the sound volume of a sound source arranged on the right side increases. When the listener turns left, the sound volume of a sound source arranged on the left side increases. For example, in instrumental music played by three guitarists, it is difficult to know through an ordinary headphone which guitarist is performing which part. However, according to the above-mentioned embodiment, it is possible to make the sound volume of one guitarist's performance louder than the other two guitarists' parts merely by turning the head of the listener wearing the headphone to the right or left. Thus, the listener may intensively listen to each player's performance. Moreover, when the listener wearing the headphone turns upward, the sound volume of a sound source located away from the listener is higher than that located close to the listener. On the contrary, when the listener faces downward, the sound volume of a sound source located close to the listener is higher.

When the operation amount of the range-control switch 19 provided in the headphone is increased, the sound volume of the sound source arranged in the direction of the indicated directional angle becomes higher and the sound volumes of the other sound sources arranged in the left, right and rear sides of the listener becomes lower.

Accordingly, even in a noisy environment for example, a particular sound source may be well heard merely by the listener turning to the direction of a target sound the listener wants to listen to and putting the listener's hand over the ear to operate the range-control switch 19. Specifically, when a plurality of virtual sound sources are arranged around the listener, the following will result.

When the range-control switch 19 (bending sensor) is not operated, all the sound sources arranged around (in 360-degree range) are audible.

When the range-control switch 19 (bending sensor) is softly operated, sounds in the rear become gradually harder to hear. For example, sounds from the left, right and rear sides of the listener become inaudible.

When the bending sensor is operated strongly, only a sound in a direction of the indicated directional angle (the listener's front) is audible.

Figure 14:
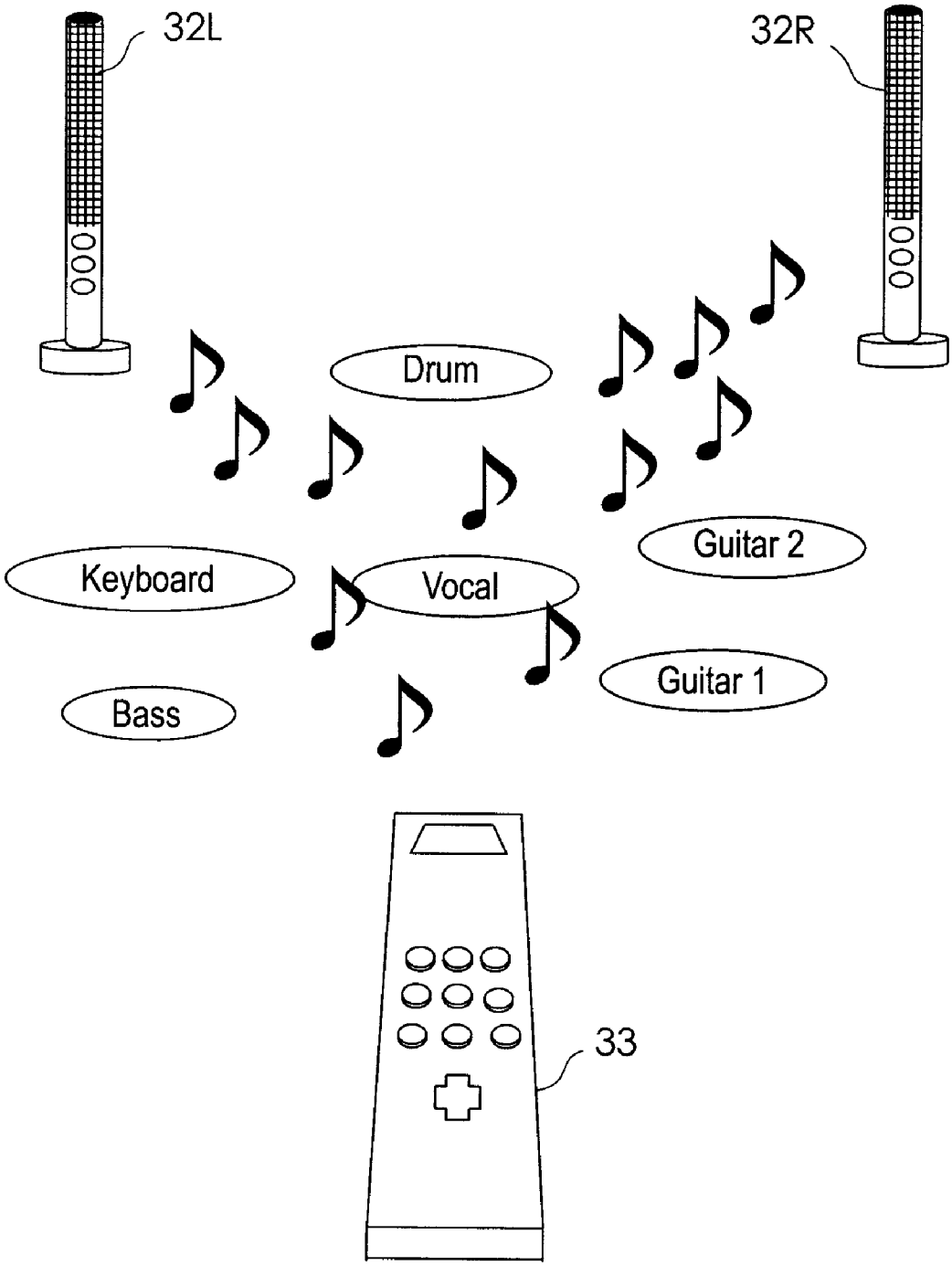
FIG. 14 conceptually illustrates a situation where a remote controller of a sound reproducing apparatus is used as the operation unit.

According to the above-mentioned embodiment, a headphone is employed as a main unit component of the operation unit 7. However, any kind of unit component may be employed as the operation unit 7 as far as it is operable by listeners. FIG. 14 conceptually illustrates a situation where the operation unit is a remote controller 33 for a sound reproducing apparatus such as home stereo-audio equipment. The remote controller 33 having a built-in directional angle detection sensor and the elevation angle detection sensor, and a part of the control switches are used as the reference direction determination switch and the range-control switch.

Figure 15:
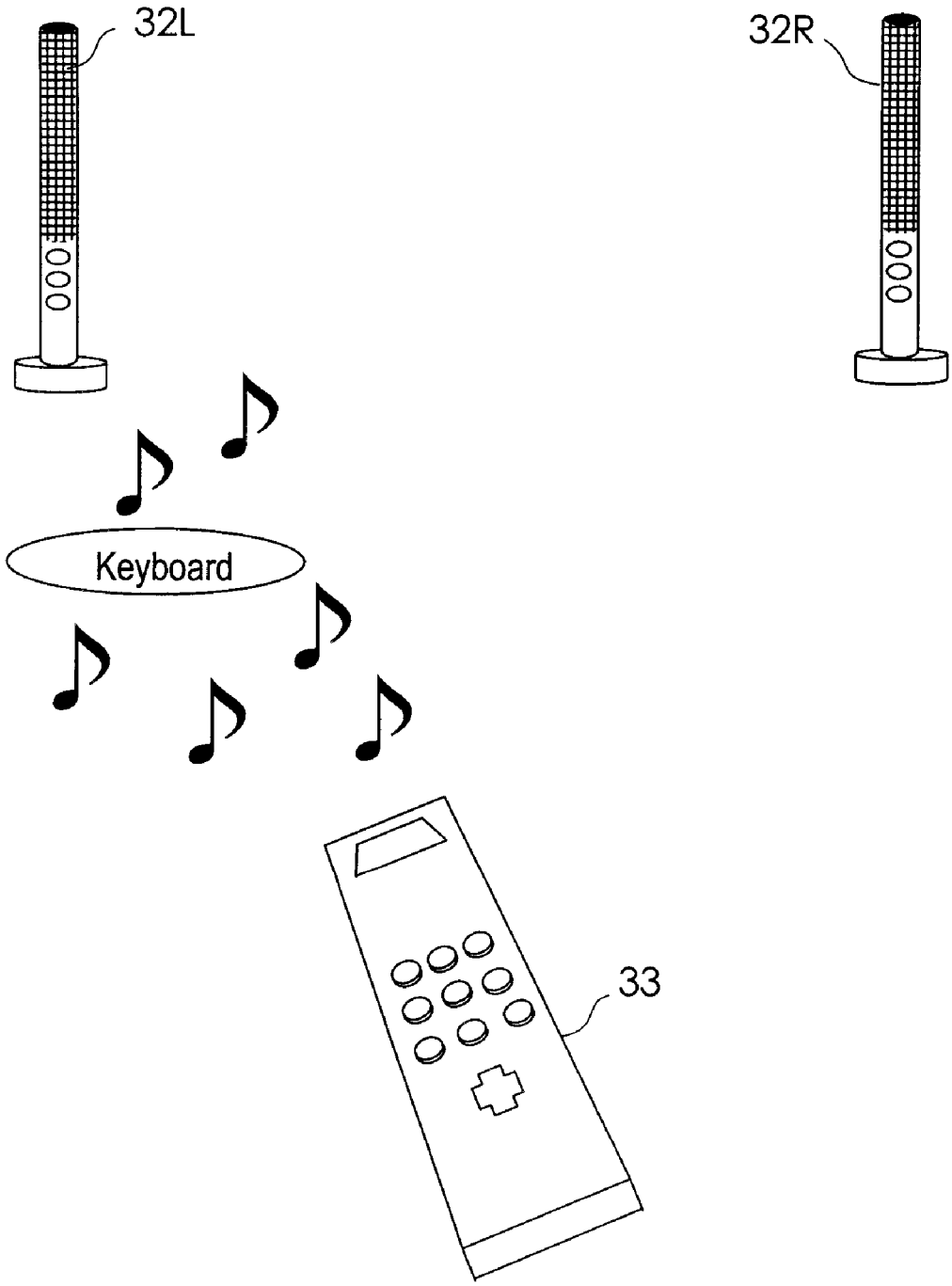
FIG. 15 illustrates a situation where the direction of one virtual sound source is indicated with the remote controller.

In this embodiment, sounds are outputted from left and right loudspeakers 32L and 32R to create virtual sound sources in front of the listener. For example, as shown in FIG. 15, when the listener points the remote controller 33 at a desired virtual sound source (keyboard in this case) and presses the range-control switch strongly, the indicated directional angle is set up so that only the virtual sound source located in the direction of the indicated directional angle is audible.

Figure 16:
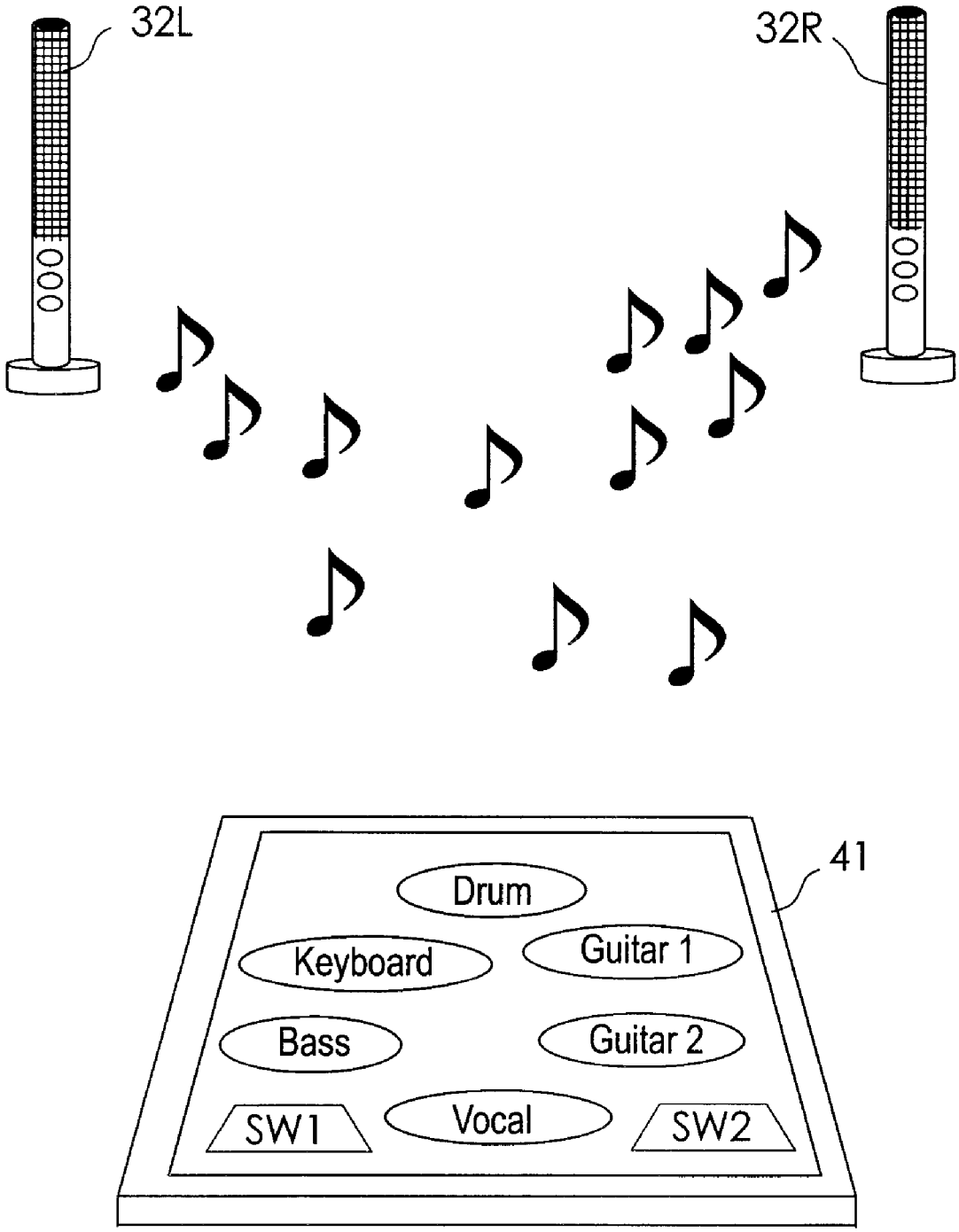
FIG. 16 illustrates a situation where a mobile terminal such as PDA (personal digital assistant) equipped with a screen for both display and input is used as the main unit component of the operation unit.
Figure 17:
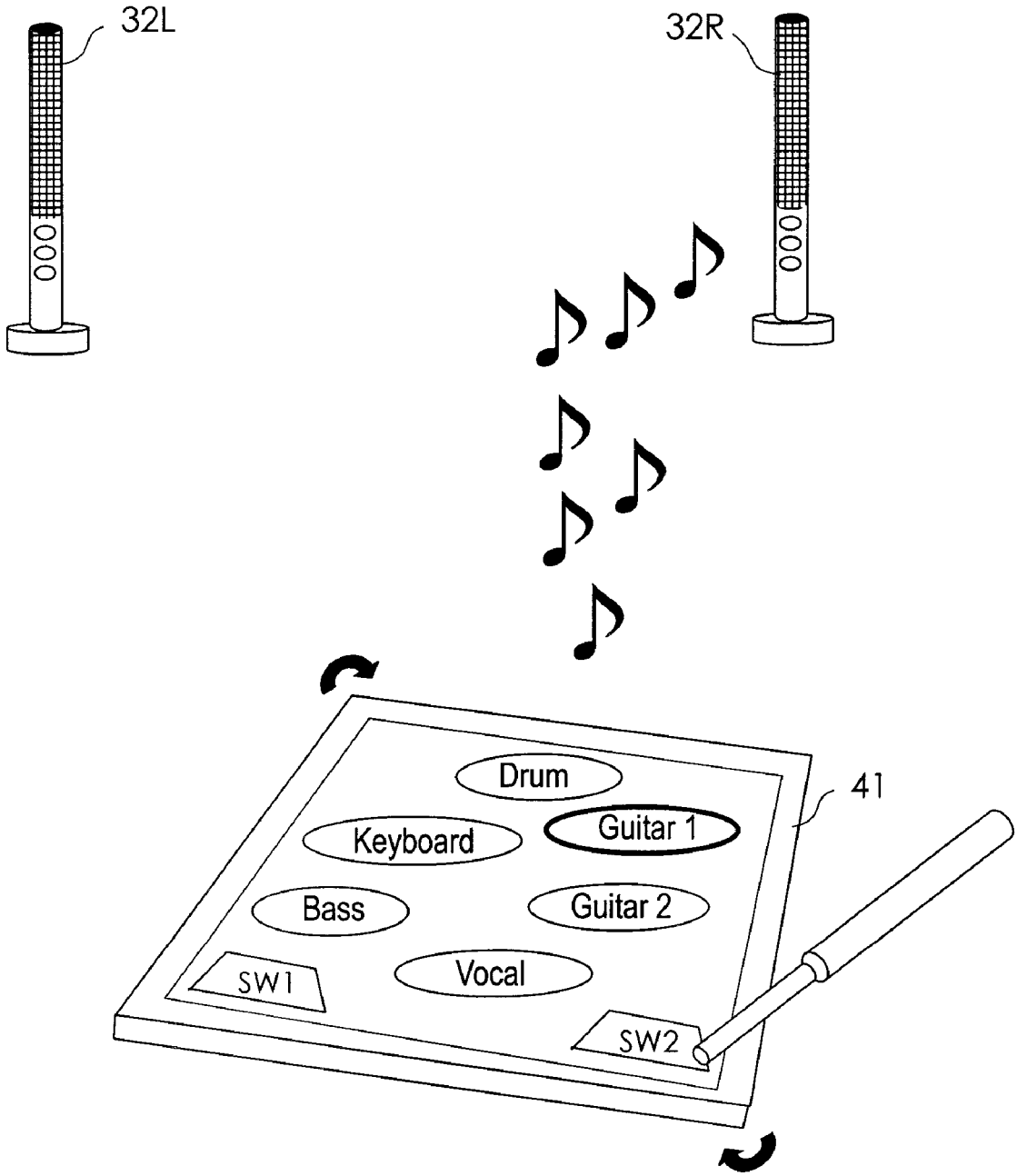
FIG. 17 illustrates a situation where the mobile terminal is used to indicate the direction of a certain virtual sound source.

FIG. 16 illustrates an example where the main unit component of the operation unit 7 is a mobile terminal such as a PDA (personal digital assistant) 41 which is equipped with a display portion serving as a display screen and an input screen. The personal digital assistant 41 includes the directional angle detection sensor 15 and the elevation angle detection sensor 17 therein. The presence of the respective virtual sound sources is explicitly displayed on the display portion of the personal digital assistant 41. When the personal digital assistant 41 is used to point to a certain virtual sound source as shown in FIG. 17, one or more virtual sound sources located in the direction of the indicated directional angle are differently displayed from the other virtual sound sources. For example, they may begin to blink or brightly light up. The audible range may be narrowed down to a specific virtual sound source by controlling how much a switch SW2 is operated, or according to the number of times that the switch SW2 is pressed.

INDUSTRIAL APPLICABILITY

According to the present invention, listeners who are not familiar with the mixing technology, may freely control the sound volume of a specific part or instrument simply by pointing to an appropriate direction using the operation unit.

The invention claimed is:

1. A mixing system comprising:

mixing means for mixing a plurality of audio signals and outputting a mixed audio signal to a sound reproducing apparatus which produces a plurality of virtual sound sources around a listener, the plurality of audio signals being supplied from a plurality of audio signal channels respectively associated with the plurality of virtual sound sources;

an operation unit to be operated by the listener; and directional angle difference detection means provided in the operation unit, for detecting a directional angle difference between a predetermined reference directional angle and an indicated directional angle which the listener determines by indicating with the operation unit a certain direction within a virtual sound source space where the plurality of virtual sound sources exist, wherein the mixing means mixes the plurality of audio signals supplied from the plurality of audio signal channels without adjustment and outputs the mixed audio signal when the directional angle difference is zero degrees; and creates a state where the plurality of virtual sound sources are fixedly located with respect to the reference directional angle, and mixes the plurality of audio signals supplied from the plurality of audio signal channels by performing sound volume adjustment and phase adjustment for the audio signals so that the sound volumes of one or more of the virtual sound sources located in a direction determined by the indicated directional angle may be higher than those of the one or more virtual sound sources at the time that the directional angle difference is zero degrees, and outputs the mixed audio signal when the directional angle difference is other than zero degrees.

2. The mixing system according to claim 1, further comprising angle range setting means for setting a given directional angle range centering on the indicated directional angle, wherein the mixing means performs, when the directional angle range is set, the sound volume adjustment for the plurality of audio signals supplied from the plurality of audio signal channels so that the sound volumes of one or more of the virtual sound sources located within the directional angle range may be higher than those of the one or more of the virtual sound sources when the directional angle difference is zero degrees, and that the sound volumes of other virtual sound sources located out of the directional angle range may be lower than those of the one or more of the virtual sound sources located within the directional angle range.

3. The mixing system according to claim 2, wherein the mixing means includes:

a channel selection section for calculating a directional angle difference between the indicated directional angle and each directional angle of the plurality of virtual sound sources, and selecting one or more of the audio signal channels respectively associated with one or more of the virtual sound sources located within the directional angle range based on the calculated directional angle differences when the directional angle range is set; and a mixing section for performing the sound volume adjustment for the plurality of audio signals supplied from the plurality of audio signal channels so that the sound volumes of one or more of the audio signals supplied from the one or more of the audio signal channels which have been selected by the channel selection section may be higher than those of other audio signal channels which have not been selected.

4. The mixing system according to claim 2, wherein the operation unit includes a range-control switch, and the angle range setting means narrows the directional angle range when the range-control switch is operated in a closing direction, and expands the directional angle range when the range-control switch is operated in an opening direction.

5. The mixing system according to claim 1, further comprising elevation angle difference detection means for defining as a reference elevation angle an elevation angle of the operation unit when the reference directional angle is determined, and for detecting a difference between the reference elevation angle and an elevation angle of the operation unit as an elevation angle difference and for outputting the elevation angle difference, the elevation angle being a positive angle when the elevation angle is formed as the operation unit is directed upward from a posture with which the reference directional angle has been determined, and a negative angle when the elevation angle is formed as the operation unit is directed downward from the posture, wherein the mixing means performs the sound volume adjustment for the plurality of audio signals supplied from the plurality of audio signal channels respectively associated with the plurality of virtual sound sources located in a direction of the indicated directional angle so that, when the elevation angle difference detection means is outputting a positive elevation angle difference, the sound volumes of the plurality of virtual sound sources located in the direction of the indicated directional angle may be increased in proportion to the elevation angle difference, and when the elevation angle difference detection means is outputting a negative elevation angle difference, the sound volumes of the plurality of virtual sound sources located in the direction of the indicated directional angle may be decreased in proportion to the elevation angle difference.

6. The mixing system according to claim 4, wherein the operation unit is constituted from a headphone as a main unit component, which the listener wears on the head; and the headphone is equipped with at least a directional angle detection sensor used for the directional angle difference detection means, an elevation angle detection sensor used for the elevation angle difference detection means, and an operation portion of the angle range setting means.

7. The mixing system according to claim 6, wherein the range-control switch is mounted onto an outside of at least one of left and right speakers of the headphone, and is operated toward the closing direction as the listener brings the hand close to the speaker, and is operated toward the opening direction automatically as the listener brings the hand away from the speaker.

8. The mixing system according to claim 2, wherein the operation unit is constituted from a remote controller as a main unit component, which the listener holds by hand for operation, and the remote controller is equipped with at least a directional angle detection sensor used for the directional angle difference detection means, an elevation angle detection sensor used for the elevation angle difference detection means, and an operation portion of the angle range setting means.

9. The mixing system according to claim 8, wherein the directional angle detection sensor and the elevation angle detection sensor are constituted from an electronic compass.

10. A mixing method of mixing a plurality of audio signals and outputting a mixed audio signal to a sound reproducing apparatus which produces a plurality of virtual sound sources around a listener, the plurality of audio signals being supplied from a plurality of audio signal channels respectively associated with the plurality of virtual sound sources, the method comprising the steps of:

preparing an operation unit to be operated by the listener;

detecting a directional angle difference between a predetermined reference directional angle and an indicated directional angle which the listener determines by indicating with the operation unit a certain direction within a virtual sound source space where the plurality of virtual sound sources exist;

mixing the plurality of audio signals supplied from the plurality of audio signal channels without adjustment and outputting the mixed audio signal when the directional angle difference is zero degrees; and creating a state where the plurality of virtual sound sources are fixedly located with respect to the reference directional angle, and mixing the plurality of audio signals supplied from the plurality of audio signal channels by performing sound volume adjustment and phase adjustment for the audio signals so that the sound volumes of one or more of the virtual sound sources located in a direction of the indicated directional angle may be higher than those of the one or more virtual sound sources at the time that the directional angle difference is zero degrees, and outputting the mixed audio signal when the directional angle difference is other than zero degrees.

11. The mixing method according to claim 10, further comprising the step of setting a given directional angle range centering on the indicated directional angle, wherein in the step of mixing, when the directional angle range is set, the sound volume adjustment for the plurality of audio signals supplied from the plurality of audio signal channels is performed so that the sound volumes of one or more of the virtual sound sources located within the directional angle range may be higher than those of the one or more of the virtual sound sources when the directional angle difference is zero degrees, and that the sound volumes of other virtual sound sources located out of the directional angle range may be lower than those of the one or more of the virtual sound sources located within the directional angle range.

12. The mixing method according to claim 10, further comprising the step of defining as a reference elevation angle an elevation angle of the operation unit when the reference directional angle is determined, detecting a difference between the reference elevation angle and an elevation angle of the operation unit as an elevation angle difference, and outputting the elevation angle difference, the elevation angle being a positive angle when the elevation angle is formed as the operation unit is directed upward from a posture with which the reference directional angle has been determined, and a negative angle when the elevation angle is formed as the operation unit is directed downward from the posture, wherein in the step of mixing, the sound volume adjustment is performed for the plurality of audio signals supplied from the plurality of audio signal channels respectively associated with the plurality of virtual sound sources located in a direction of the indicated directional angle so that, when a positive elevation angle difference is being detected, the sound volumes of the plurality of virtual sound sources located in the direction of the indicated directional angle may be increased in proportion to the elevation angle difference, and when a negative elevation angle difference is being detected, the sound volume of the plurality of virtual sound sources located in the direction of the indicated directional angle may be decreased in proportion to the elevation angle difference.

13. A computer program for mixing a plurality of audio signals and outputting a mixed audio signal to a sound reproducing apparatus which produces a plurality of virtual sound sources around a listener, the plurality of audio signals being supplied from a plurality of audio signal channels respectively associated with the plurality of virtual sound sources, the program causing a computer to perform the steps of:

detecting a directional angle difference between a predetermined reference directional angle and an indicated directional angle which the listener determines by indicating with an operation unit a certain direction within a virtual sound source space where the plurality of virtual sound sources exist;

setting a given directional angle range centering on the indicated directional angle;

defining as a reference elevation angle an elevation angle of the operation unit when the reference directional angle is determined, detecting a difference between the reference elevation angle and an elevation angle of the operation unit as an elevation angle difference, and outputting the elevation angle difference, the elevation angle being a positive angle when the elevation angle is formed as the operation unit is directed upward from a posture with which the reference directional angle has been determined, and a negative angle when the elevation angle is formed as the operation unit is directed downward from the posture; and mixing the plurality of audio signals supplied from the plurality of audio signal channels without adjustment and outputting the mixed audio signal when the directional angle difference is zero degrees; and creating a state where the plurality of virtual sound sources are fixedly located with respect to the reference directional angle, and mixing the plurality of audio signals supplied from the plurality of audio signal channels by performing sound volume adjustment and phase adjustment for the audio signals so that the sound volumes of one or more of the virtual sound sources located in a direction of the indicated directional angle may be higher than those of the one or more virtual sound sources at the time that the directional angle difference is zero degrees, and outputting the mixed audio signal when the directional angle difference is other than zero degrees, and by performing the sound volume adjustment for the plurality of audio signals supplied from the plurality of audio signal channels, when the directional angle range is set, so that the sound volumes of one or more of the virtual sound sources located within the directional angle range may be higher than those of the one or more of the virtual sound sources when the directional angle difference is zero degrees, and that the sound volumes of other virtual sound sources located out of the directional angle range may be lower than those of the one or more of the virtual sound sources located within the directional angle range, and by performing the sound volume adjustment for the plurality of audio signals supplied from the plurality of audio signal channels respectively associated with the plurality of virtual sound sources located in a direction of the indicated directional angle so that, when a positive elevation angle difference is being detected, the sound volumes of the plurality of virtual sound sources located in the direction of the indicated directional angle may be increased in proportion to the elevation angle difference, and when a negative elevation angle difference is being detected, the sound volumes of the plurality of virtual sound sources located in the direction of the indicated directional angle may be decreased in proportion to the elevation angle difference.

* * * * *